US010842306B2

(12) United States Patent
Leung et al.

(10) Patent No.: US 10,842,306 B2
(45) Date of Patent: Nov. 24, 2020

(54) MULTI-WIRE QUICK ASSEMBLE TREE

(71) Applicant: Polygroup Macau Limited (BVI), Tortola (VG)

(72) Inventors: Chi Yin Alan Leung, Apleichau (HK); Chang Jun He, Shenzhen (CN); Chi Kin Samuel Kwok, Shenzhen (CN)

(73) Assignee: Polygroup Macau Limited (BVI), Tortola (VG)

( * ) Notice: Subject to any disclaimer, the term of this patent is extended or adjusted under 35 U.S.C. 154(b) by 0 days.

(21) Appl. No.: 15/837,140

(22) Filed: Dec. 11, 2017

(65) Prior Publication Data

US 2018/0098655 A1 Apr. 12, 2018

Related U.S. Application Data

(63) Continuation of application No. 15/081,067, filed on Mar. 25, 2016, now Pat. No. 9,839,315.

(60) Provisional application No. 62/139,046, filed on Mar. 27, 2015.

(51) Int. Cl.
*A47G 33/06* (2006.01)

(52) U.S. Cl.
CPC ..... *A47G 33/06* (2013.01)

(58) Field of Classification Search
CPC ..... A41G 1/005; A47G 33/06; A47G 33/08; A47G 2033/0827; F21S 6/00; H01R 24/38
USPC ..... 439/894, 675; 362/123
See application file for complete search history.

(56) References Cited

U.S. PATENT DOCUMENTS

| | | | |
|---|---|---|---|
| 377,953 | A | 2/1888 | Mills |
| 438,310 | A | 10/1890 | Edison |
| 534,021 | A | 2/1895 | Swan |
| 735,010 | A | 7/1903 | Zahl |
| 918,083 | A | 4/1909 | Palmer |
| 1,456,194 | A | 5/1923 | Rosenberg |

(Continued)

FOREIGN PATENT DOCUMENTS

| | | |
|---|---|---|
| AU | 4837796 | 9/1996 |
| CA | 1182513 A | 2/1985 |

(Continued)

OTHER PUBLICATIONS

Patent Owner's Preliminary Response for IPR2016-01782, *Polygroup Limited (MCO)* v. *Willis Electric Co., Ltd.*, filed Feb. 21, 2017.

(Continued)

*Primary Examiner* — Vanessa Girardi
(74) *Attorney, Agent, or Firm* — Troutman Pepper Hamilton Sanders LLP; Ryan A. Schneider; Christopher C. Close, Jr.

(57) ABSTRACT

A power transfer system to facilitate the transfer of electrical power between tree trunk sections of an artificial tree is disclosed. The power transfer system can advantageously enable neighboring tree trunk sections to be electrically connected without the need to rotationally align the tree trunk sections. Power distribution systems can be disposed within the trunk sections. The power distribution systems can comprise a male end, a female end, or both. The male ends can have prongs and the female ends can have voids. The prongs can be inserted into the voids to electrically connect the power distribution systems of neighboring tree trunk sections. In some embodiments, the prongs and voids are designed so that the prongs of one power distribution system can engage the voids of another power distribution (Continued)

system without the need to rotationally align the tree trunk sections.

12 Claims, 21 Drawing Sheets

(56) References Cited

U.S. PATENT DOCUMENTS

| | | | |
|---|---|---|---|
| 1,479,420 | A | 1/1924 | Nenno |
| 1,495,695 | A | 5/1924 | Karr |
| 1,590,220 | A | 6/1924 | Wurts |
| 1,656,148 | A | 1/1928 | Harris |
| 1,837,890 | A | 12/1931 | Goater |
| 1,922,022 | A | 8/1933 | Barnett |
| 1,974,472 | A | 9/1934 | Seghers |
| 2,025,189 | A | 12/1935 | Yanchenko |
| 2,047,045 | A | 7/1936 | Veenboer |
| 2,112,281 | A | 3/1938 | Ferris |
| 2,151,897 | A | 3/1939 | Chaplin |
| 2,188,529 | A | 1/1940 | Corina |
| 2,227,123 | A | 12/1940 | Christen |
| 2,229,211 | A | 1/1941 | Korengold |
| 2,242,597 | A | 5/1941 | Quandee |
| 2,275,533 | A | 3/1942 | Landy |
| 2,277,532 | A | 3/1942 | Smith, Jr. |
| 2,284,837 | A | 6/1942 | O'Brien |
| 2,402,766 | A | 6/1946 | Moore |
| 2,453,695 | A | 11/1948 | Belling |
| 2,453,925 | A | 11/1948 | Mendonca |
| 2,481,181 | A | 9/1949 | Walter |
| 2,485,460 | A | 10/1949 | Rocco |
| 2,515,255 | A | 7/1950 | O'Brien et al. |
| 2,533,374 | A | 12/1950 | Hyland |
| 2,558,029 | A | 6/1951 | Wood |
| 2,563,713 | A | 8/1951 | Frei et al. |
| 2,605,386 | A | 7/1952 | Syretz |
| 2,679,911 | A | 6/1954 | Bhend |
| 2,684,401 | A | 7/1954 | Roeser |
| 2,759,095 | A | 8/1956 | Kline |
| 2,806,938 | A | 9/1957 | Henry |
| 2,857,506 | A | 10/1958 | Minteer |
| 2,875,421 | A | 2/1959 | Jordan |
| 2,910,842 | A | 11/1959 | Senseng |
| 2,932,811 | A | 4/1960 | Abraham et al. |
| 2,938,355 | A | 5/1960 | Dougherty |
| 2,969,456 | A | 1/1961 | Raymaley |
| 2,973,546 | A | 3/1961 | Roche |
| 2,977,566 | A | 3/1961 | Neumann et al. |
| 3,009,052 | A | 11/1961 | Holbrook |
| 3,019,357 | A | 1/1962 | Zaffina |
| 3,101,291 | A | 8/1963 | Lalick |
| 3,107,966 | A | 10/1963 | Bonhomme |
| 3,115,435 | A | 12/1963 | Abramson |
| 3,118,617 | A | 1/1964 | Hellrich |
| 3,131,112 | A | 4/1964 | Abramson |
| 3,133,703 | A | 5/1964 | Monroe |
| 3,214,579 | A | 10/1965 | Pacini |
| 3,234,073 | A | 2/1966 | Raymond et al. |
| 3,290,918 | A | 12/1966 | Weasler |
| 3,300,163 | A | 1/1967 | Randolf |
| 3,306,206 | A | 2/1967 | Grantham |
| 3,390,369 | A | 7/1968 | Zavertnik et al. |
| 3,409,867 | A | 11/1968 | Lessner |
| 3,470,527 | A | 9/1969 | Bonhomme |
| 3,521,216 | A | 7/1970 | Tolegian |
| 3,531,759 | A | 9/1970 | Hansen |
| 3,571,586 | A | 3/1971 | Duckworth |
| 3,585,564 | A | 6/1971 | Skjervoll |
| 3,602,531 | A | 8/1971 | Patry |
| 3,603,780 | A | 9/1971 | Lu |
| 3,617,732 | A | 11/1971 | Fisher |
| 3,634,180 | A | 1/1972 | DeCosmo et al. |
| 3,640,496 | A | 2/1972 | Duncan |
| 3,652,972 | A | 3/1972 | Kreider |
| 3,663,924 | A | 5/1972 | Gerlat |
| 3,715,708 | A | 2/1973 | Lloyd et al. |
| 3,723,723 | A | 3/1973 | Lerner |
| 3,735,117 | A | 5/1973 | Hunt |
| 3,902,781 | A | 9/1975 | Kommern et al. |
| 3,924,882 | A | 12/1975 | Ellis |
| 3,928,689 | A | 12/1975 | Mottel |
| 3,945,707 | A | 3/1976 | Fitzgerald |
| 3,963,321 | A | 6/1976 | Burger et al. |
| 3,970,832 | A | 7/1976 | Smith |
| 3,970,834 | A | 7/1976 | Smith |
| 3,971,619 | A | 7/1976 | Rohrssen |
| 3,985,924 | A | 10/1976 | Pritza |
| 4,005,923 | A | 2/1977 | Davis, Jr. |
| 4,020,201 | A | 4/1977 | Miller |
| 4,054,696 | A | 10/1977 | Crownover |
| 4,057,665 | A | 11/1977 | Szulewski |
| 4,068,118 | A | 1/1978 | Carrington |
| 4,072,857 | A | 2/1978 | Devicaris |
| 4,097,917 | A | 6/1978 | McCaslin |
| 4,109,345 | A | 8/1978 | Sargent et al. |
| 4,140,823 | A | 2/1979 | Weskamp |
| 4,247,216 | A | 1/1981 | Pansini |
| 4,318,630 | A | 3/1982 | Herchenbach et al. |
| 4,336,974 | A | 6/1982 | Wilson |
| 4,385,849 | A | 5/1983 | Crain |
| 4,437,782 | A | 3/1984 | Geisthoff |
| 4,447,279 | A | 5/1984 | Boisvert et al. |
| 4,462,065 | A | 7/1984 | Rhodes |
| 4,516,193 | A | 5/1985 | Murphy |
| 4,525,773 | A | 6/1985 | Hesse et al. |
| 4,545,750 | A | 10/1985 | Davis |
| 2,595,248 | A | 6/1986 | Brown |
| 4,595,248 | A | 6/1986 | Brown |
| 4,602,831 | A | 7/1986 | Lockard |
| 4,620,270 | A | 10/1986 | Laakso |
| 4,636,106 | A | 1/1987 | Waisbrod |
| 4,655,515 | A | 4/1987 | Hamsher, Jr. et al. |
| 4,662,775 | A | 5/1987 | Faul |
| 4,705,483 | A | 11/1987 | Davis et al. |
| 4,737,120 | A | 4/1988 | Grabbe et al. |
| 4,753,600 | A | 6/1988 | Williams |
| 4,772,215 | A | 9/1988 | Falk |
| 4,775,922 | A | 10/1988 | Engel |
| 4,793,646 | A | 12/1988 | Michaud, Jr. |
| 4,805,075 | A | 2/1989 | Damore |
| 4,830,626 | A | 5/1989 | Liu |
| 4,855,880 | A | 8/1989 | Mancusi, Jr. |
| 4,858,086 | A | 8/1989 | Pietrantonio et al. |
| 5,015,510 | A | 3/1991 | Smith |
| 5,067,906 | A | 11/1991 | Woodgate |
| 5,073,129 | A | 12/1991 | Szegda |
| 5,088,669 | A | 2/1992 | Zinnbauer |
| 5,091,834 | A | 2/1992 | Kao |
| 5,149,223 | A | 9/1992 | Watts |
| 5,149,282 | A | 9/1992 | Donato et al. |
| 5,217,393 | A | 6/1993 | Del Negro et al. |
| 5,276,280 | A | 1/1994 | Ball |
| 5,300,864 | A | 4/1994 | Allen, Jr. |
| 5,306,176 | A | 4/1994 | Coffey |
| 5,349,780 | A | 9/1994 | Dyke |
| 5,362,251 | A | 11/1994 | Bielak |
| 5,431,578 | A | 2/1995 | Wayne et al. |
| 5,409,403 | A | 4/1995 | Falossi |
| 5,409,745 | A | 4/1995 | McGuire |
| 5,422,797 | A | 6/1995 | Shattan |
| 5,454,729 | A | 10/1995 | Wen-Te |
| 5,455,750 | A | 10/1995 | Davis |
| 5,492,429 | A | 2/1996 | Hodges |
| 5,517,390 | A | 5/1996 | Zins |
| 5,550,720 | A | 8/1996 | Carroll |
| 5,603,626 | A | 2/1997 | Wayne et al. |
| 5,629,587 | A | 5/1997 | Gray et al. |
| 5,639,157 | A | 6/1997 | Yeh |
| 5,652,032 | A | 7/1997 | Kaczor et al. |
| 5,667,393 | A | 9/1997 | Grabbe et al. |
| 5,695,279 | A | 12/1997 | Sonnleitner et al. |
| 5,712,002 | A | 1/1998 | Reilly, III |
| 5,758,545 | A | 6/1998 | Fevre |
| 5,776,559 | A | 7/1998 | Woolford |

(56) References Cited

U.S. PATENT DOCUMENTS 5,776,599 A 7/1998 Haluska et al.
5,803,750 A 9/1998 Purington et al.
5,855,705 A 1/1999 Gauthier
5,878,989 A 3/1999 Allman
5,957,562 A 9/1999 Hill
5,979,859 A 11/1999 Vartanov et al.
6,030,670 A 2/2000 Chang
6,056,427 A 5/2000 Kao
6,065,233 A 5/2000 Rink
6,068,490 A 5/2000 Salzberg
6,091,204 A 7/2000 Chen
6,099,920 A 8/2000 Kao
6,226,146 B1 5/2001 Landess et al.
6,241,559 B1 6/2001 Taylor
6,257,793 B1 7/2001 Lin
6,273,584 B1 8/2001 Wang et al.
6,323,597 B1 11/2001 Janning
6,354,231 B1 3/2002 Morris
6,418,949 B1 7/2002 Lin
6,457,839 B1 10/2002 Grandoit
6,458,435 B1 10/2002 Lai
6,462,311 B1 10/2002 Emiglio
6,588,914 B1 7/2003 Tang
6,592,094 B1 7/2003 Kao
6,619,876 B2 9/2003 Vaikus et al.
6,652,927 B1 11/2003 Chen
6,695,464 B1 2/2004 Wu
6,733,167 B1 5/2004 Kao
6,752,512 B2 6/2004 Pan
6,773,134 B2 8/2004 Harvey
6,794,574 B2 9/2004 Gust
6,794,825 B1 9/2004 Kao
6,796,683 B2 9/2004 Wood et al.
6,840,663 B2 1/2005 Kao
6,854,916 B2 2/2005 Hsieh
6,869,316 B2 3/2005 Hinkle et al.
6,883,951 B2 4/2005 Wu
6,945,805 B1 9/2005 Bollinger
6,951,405 B2 10/2005 Yao
7,021,598 B2 4/2006 Kao
7,029,145 B2 4/2006 Frederick
7,052,156 B2 5/2006 Primeau
7,055,981 B2 6/2006 Yao
7,066,739 B2 6/2006 McLeish
7,081,027 B2 7/2006 Woodward
7,108,514 B2 9/2006 Chen et al.
7,122,230 B1 10/2006 Maskell
7,074,044 B2 11/2006 Billing et al.
7,132,139 B2 11/2006 Yang
7,144,610 B1 12/2006 Estes et al.
7,186,050 B2 3/2007 Dean
7,192,303 B2 3/2007 Kohen
7,196,477 B2 3/2007 Richmond
7,207,844 B2 4/2007 Peng
7,264,479 B1 9/2007 Lee
7,279,633 B2 10/2007 Waters
7,311,421 B1 12/2007 Fahl
7,311,566 B2 12/2007 Dent
7,318,744 B2 1/2008 Kuo
7,322,720 B1 1/2008 Haddad
7,322,873 B2 1/2008 Rosen et al.
7,361,039 B2 4/2008 Koehler
7,404,686 B2 7/2008 Volum
7,429,827 B2 9/2008 Richmond
7,445,824 B2 11/2008 Leung et al.
7,527,508 B1 5/2009 Lee
7,537,457 B2 5/2009 Rashkover
7,554,266 B1 6/2009 Chen
7,585,187 B2 9/2009 Daily et al.
7,585,552 B2 9/2009 Meseke
7,609,006 B2 10/2009 Gibboney
7,652,210 B2 1/2010 White
7,665,996 B2 2/2010 Jaeger
7,784,961 B1 8/2010 Rawlings
7,819,575 B2 10/2010 Li
7,943,211 B2 5/2011 Chen
7,980,871 B2 7/2011 Li et al.
8,047,700 B2 11/2011 Massabki et al.
8,052,442 B1 11/2011 Li et al.
8,053,042 B1 11/2011 Loomis
8,062,718 B2 11/2011 Schooley
8,100,546 B2 1/2012 Lutz et al.
8,132,649 B2 3/2012 Rogers
8,226,269 B2 7/2012 Mateer et al.
8,235,737 B2 8/2012 Cheng et al.
8,298,633 B1 10/2012 Chen
8,309,188 B2 11/2012 Cheng et al.
8,384,294 B2 2/2013 Hatley et al.
8,403,523 B2 3/2013 Gerlach et al.
8,419,455 B2 4/2013 Cheng et al.
8,454,186 B2 6/2013 Chen
8,454,187 B2 6/2013 Chen
8,469,734 B2 6/2013 Chen
8,527,508 B2 9/2013 Takahashi et al.
8,568,015 B2 10/2013 Chen
8,573,548 B2 11/2013 Kuhn et al.
8,593,074 B2 11/2013 Hatley et al.
8,633,649 B2 1/2014 Hatley et al.
8,723,450 B2 5/2014 Hatley et al.
8,753,135 B2 6/2014 Cheng et al.
8,863,416 B2 10/2014 Leung et al.
8,870,404 B1 10/2014 Chen
8,916,242 B2 12/2014 Fu et al.
8,936,379 B1 1/2015 Chen
8,959,810 B1 2/2015 Leung et al.
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung
9,173,443 B2 11/2015 Loomis
9,179,793 B2 11/2015 Chen
9,441,800 B1 9/2016 Chen
9,441,823 B1 9/2016 Chen
9,572,446 B2 2/2017 Chen
9,912,109 B2 3/2018 Leung et al.
2003/0073325 A1 4/2003 Canizales, Jr.
2004/0002266 A1 1/2004 Hinkle et al.
2005/0148241 A1 7/2005 Kohen
2005/0249892 A1 11/2005 Rocheleau
2006/0048397 A1 3/2006 King et al.
2006/0062940 A1 3/2006 Steiger et al.
2006/0068129 A1 3/2006 Yang
2006/0164834 A1 7/2006 Kao
2006/0264080 A1 11/2006 Peng
2007/0230174 A1 10/2007 Hicks et al.
2007/0253191 A1 11/2007 Chin et al.
2007/0273296 A9 11/2007 Janning
2008/0143267 A1 6/2008 Neuman
2008/0149791 A1 6/2008 Bradley
2008/0283717 A1 11/2008 Kim et al.
2009/0023315 A1 1/2009 Pfeiffer
2010/0000065 A1 1/2010 Cheng et al.
2010/0053991 A1 3/2010 Boggs
2010/0072747 A1 3/2010 Krize
2010/0099287 A1 4/2010 Colburn et al.
2010/0157601 A1 6/2010 Robb
2010/0159713 A1 6/2010 Nishihira et al.
2010/0196628 A1 8/2010 Shooley
2010/0271804 A1 10/2010 Levine
2010/0289415 A1 11/2010 Chen
2011/0085327 A1 4/2011 Chen
2011/0195204 A1 8/2011 Chen
2011/0215368 A1 9/2011 Chen
2011/0256750 A1 10/2011 Chen
2011/0286223 A1 11/2011 Chen
2011/0303939 A1 12/2011 Chen
2011/0305022 A1 12/2011 Chen
2012/0075863 A1 3/2012 Chen
2012/0076957 A1 3/2012 Chen
2012/0236546 A1 9/2012 Chen
2012/0327658 A1 12/2012 Chen
2013/0108808 A1 5/2013 Leung et al.
2013/0120971 A1 5/2013 Chen

(56) References Cited

U.S. PATENT DOCUMENTS

| | | | |
|---|---|---|---|
| 2013/0163231 | A1 | 6/2013 | Chen |
| 2013/0301246 | A1 | 11/2013 | Chen |
| 2013/0309908 | A1 | 11/2013 | Sandoval et al. |
| 2014/0215864 | A1 | 8/2014 | Fischer et al. |
| 2015/0029703 | A1 | 1/2015 | Chen |
| 2017/0040755 | A1 | 2/2017 | Leung et al. |

FOREIGN PATENT DOCUMENTS

| | | | |
|---|---|---|---|
| CA | 2214074 | | 9/1996 |
| CN | 2332290 | Y | 8/1999 |
| CN | 202997132 | U | 6/2013 |
| DE | 843632 | U1 | 7/1952 |
| DE | 8436328.2 | U1 | 12/1984 |
| DE | 8436328.2 | U1 | 4/1985 |
| DE | 3521216 | A1 | 5/1986 |
| DE | 10235081 | A1 | 2/2004 |
| DE | 202004003019 | U1 | 5/2004 |
| EP | 0920826 | A1 | 6/1999 |
| EP | 1049206 | A2 | 11/2000 |
| EP | 1586809 | A2 | 10/2005 |
| EP | 2533374 | A1 | 12/2012 |
| FR | 1215214 | A | 4/1960 |
| FR | 2653853 | A1 | 5/1991 |
| GB | 591432 | A | 8/1944 |
| GB | 591432 | A1 | 8/1944 |
| GB | 792079 | A | 3/1958 |
| GB | 1569099 | A | 6/1980 |
| GB | 2112281 | A | 7/1983 |
| GB | 2137086 | A | 10/1984 |
| GB | 2169198 | A | 7/1986 |
| JP | 1999121123 | A | 4/1999 |
| NO | 0182654 | A1 | 11/2001 |
| WO | 9626661 | A | 9/1996 |
| WO | 9626661 | A1 | 9/1996 |
| WO | 0182654 | A1 | 11/2001 |
| WO | 2002075862 | A1 | 9/2002 |
| WO | 03058114 | A1 | 7/2003 |
| WO | 2005023062 | A2 | 3/2005 |
| WO | 2007043896 | A1 | 4/2007 |
| WO | 20070043896 | A1 | 4/2007 |
| WO | 2007140648 | A1 | 12/2007 |
| WO | 2010082049 | A1 | 7/2010 |
| WO | 2010082049 | A1 | 2/2011 |
| WO | 2011015340 | A1 | 2/2011 |

OTHER PUBLICATIONS

Decision Granting Institution of Inter Partes Review for IPR2016-01782, *Polygroup Limited (MCO)* v. *Willis Electric Co., Ltd.*, filed May 9, 2017.

Petition for Inter Partes Review for IPR2016-00802, *Polygroup Limited (MCO)* v. *Willis Electric Co., Ltd.*, filed Apr. 28, 2016.

Patent Owner's Preliminary Response for IPR2016-00802, *Polygroup Limited (MCO)* v. *Willis Electric Co., Ltd.*, filed Aug. 4, 2016.

Decision Granting Institution of Inter Partes Review for IPR2016-00802, *Polygroup Limited (MCO)* v. *Willis Electric Co., Ltd.*, filed Oct. 17, 2016.

Decision Granting Joint Motion Regarding Multiple Proceedings for IPR2016-00802, *Polygroup Limited (MCO)* v. *Willis Electric Co., Ltd.*, filed Feb. 15, 2017.

Termination of Trial Without Rendering Final Written Decision for IPR2016-00802, *Polygroup Limited (MCO)* v. *Willis Electric Co., Ltd.*, filed Feb. 28, 2017.

Petition for Inter Partes Review for IPR2016-01613 for *Polygroup Limited (MCO)* v. *Willis Electric Co., Ltd.*, filed Sep. 1, 2016.

Patent Owner's Preliminary Response for IPR2016-01613 for *Polygroup Limited (MCO)* v. *Willis Electric Co., Ltd.*, filed Dec. 9, 2016.

Decision Granting Joint Motion Regarding Multiple Proceedings for IPR2016-01613 for *Polygroup Limited (MCO)* v. *Willis Electric Co., Ltd.*, filed Feb. 15, 2017.

Decision Granting Institution of Inter Partes Review for IPR2016-01613 for *Polygroup Limited (MCO)* v. *Willis Electric Co., Ltd.*, filed Feb. 27, 2017.

Petition for Inter Partes Review for IPR2016-01783, *Polygroup Limited (MCO)* v. *Willis Electric Co., Ltd.*, filed Nov. 2, 2016.

Patent Owner's Preliminary Response for IPR2016-01783, *Polygroup Limited (MCO)* v. *Willis Electric Co., Ltd.*, filed Feb. 21, 2017.

Decision Denying Institution of Inter Partes Review for IPR2016-01783, *Polygroup Limited (MCO)* v. *Willis Electric Co., Ltd.*, filed Apr. 13, 2017.

Petition for Inter Partes Review for IPR2017-00330, *Willis Electric Co., Ltd.* v. *Polygroup Macau Ltd. (BVI)*, filed Nov. 24, 2016.

Patent Owner's Preliminary Response for IPR2017-00330, *Willis Electric Co., Ltd.* v. *Polygroup Macau Ltd. (BVI)*, filed Mar. 8, 2017.

Decision Denying Institution of Inter Partes Review for IPR2017-00330, *Willis Electric Co., Ltd.* v. *Polygroup Macau Ltd. (BVI)*, filed May 25, 2017.

Petition for Inter Partes Review for IPR2017-00309, *Willis Electric Co., Ltd.* v. *Polygroup Macau Ltd. (BVI)*, filed Nov. 21, 2016.

Patent Owner's Preliminary Response for IPR2017-00309, *Willis Electric Co., Ltd.* v. *Polygroup Macau Ltd. (BVI)*, filed Mar. 8, 2017.

Decision Granting Institution of Inter Partes Review for IPR2017-00309, *Willis Electric Co., Ltd.* v. *Polygroup Macau Ltd. (BVI)*, filed May 15, 2017.

Petition for Inter Partes Review for IPR2017-00334, *Willis Electric Co., Ltd.* v. *Polygroup Macau Ltd. (BVI)*, filed Nov. 25, 2016.

Patent Owner's Preliminary Response for IPR2017-00334, *Willis Electric Co., Ltd.* v. *Polygroup Macau Ltd. (BVI)*, filed Mar. 13, 2017.

Decision Granting Institution of Inter Partes Review and Consolidating Claims 1-10 from IPR2017-00335 for IPR2017-00334, *Willis Electric Co., Ltd.* v. *Polygroup Macau Ltd. (BVI)*, filed May 15, 2017.

Petition for Inter Partes Review for IPR2017-00335, *Willis Electric Co., Ltd.* v. *Polygroup Macau Ltd. (BVI)*, filed Nov. 25, 2016.

Patent Owner's Preliminary Response for IPR2017-00335, *Willis Electric Co., Ltd.* v. *Polygroup Macau Ltd. (BVI)*, filed Mar. 13, 2017.

Decision Granting Institution of Inter Partes Review and Consolidating into IPR2017-00334 for IPR2017-00335, *Willis Electric Co., Ltd.* v. *Polygroup Macau Ltd. (BVI)*, filed May 15, 2017.

Petition for Inter Partes Review for IPR2017-00331, *Willis Electric Co., Ltd.* v. *Polygroup Macau Ltd. (BVI)*, filed Nov. 24, 2016.

Patent Owner's Preliminary Response for IPR2017-00331, *Willis Electric Co., Ltd.* v. *Polygroup Macau Ltd. (BVI)*, filed Mar. 8, 2017.

Decision Granting Institution of Inter Partes Review for IPR2017-00331, *Willis Electric Co., Ltd.* v. *Polygroup Macau Ltd. (BVI)*, filed May 9, 2017.

Petition for Inter Partes Review for IPR2017-00332, *Willis Electric Co., Ltd.* v. *Polygroup Macau Ltd. (BVI)*, filed Nov. 25, 2016.

Patent Owner's Preliminary Response for IPR2017-00332, *Willis Electric Co., Ltd.* v. *Polygroup Macau Ltd. (BVI)*, filed Mar. 8, 2017.

Decision Granting Institution of Inter Partes Review for IPR2017-00332, *Willis Electric Co., Ltd.* v. *Polygroup Macau Ltd. (BVI)*, filed May 9, 2017.

Declaration of Mike Wood filed in IPR2014-01263, *Polygroup Limited* v. *Willis Electric Co., Ltd.* on Aug. 8, 2014.

Declaration of Mike Wood filed in IPR2014-01264, *Polygroup Limited* v. *Willis Electric Co., Ltd.* on Aug. 8, 2014.

C.V. of Mike Wood filed in IPR2016-00800, *Polygroup Limited (MCO)* v. *Willis Electric Co., Ltd.* on Apr. 18, 2014.

Declaration of Larina A. Alton filed in IPR2016-00800, *Polygroup Limited (MCO)* v. *Willis Electric Co., Ltd.* on Aug. 8, 2014.

Declaration of Larina A. Alton filed in IPR2016-00800, *Polygroup Limited (MCO)* v. *Willis Electric Co., Ltd.* on Dec. 23, 2016.

Declaration of Mike Wood filed in IPR2016-00800, *Polygroup Limited (MCO)* v. *Willis Electric Co., Ltd.* on Apr. 18, 2016.

Declaration of Ricky Tong filed in IPR2016-00800, *Polygroup Limited (MCO)* v. *Willis Electric Co., Ltd.* on Dec. 30, 2016.

Declaration of Stuart Brown filed in IPR2016-00800, *Polygroup Limited (MCO)* v. *Willis Electric Co., Ltd.* on Jul. 19, 2016.

Declaration of Winston Tan filed in IPR2016-00800, *Polygroup Limited (MCO)* v. *Willis Electric Co., Ltd.* on Dec. 22, 2016.

(56) References Cited

OTHER PUBLICATIONS

C.V. of Mike Wood filed in IPR2016-00801, *Polygroup Limited (MCO)* v. *Willis Electric Co., Ltd.* on Apr. 18, 2016.
Declaration of Larina A. Alton filed in IPR2016-00801, *Polygroup Limited (MCO)* v. *Willis Electric Co., Ltd.* on Jul. 19, 2016.
Declaration of Larina A. Alton filed in IPR2016-00801, *Polygroup Limited (MCO)* v. *Willis Electric Co., Ltd.* on Dec. 22, 2016.
Declaration of Mike Wood filed in IPR2016-00801, *Polygroup Limited (MCO)* v. *Willis Electric Co., Ltd.* on Apr. 18, 2016.
Declaration of Ricky Tong filed in IPR2016-00801, *Polygroup Limited (MCO)* v. *Willis Electric Co., Ltd.* on Dec. 30, 2016.
Declaration of Stuart Brown filed in IPR2016-00801, *Polygroup Limited (MCO)* v. *Willis Electric Co., Ltd.* on Jul. 19, 2016.
Declaration of Winston Tan filed in IPR2016-00802, *Polygroup Limited (MCO)* v. *Willis Electric Co., Ltd.* on Dec. 22, 2016.
C.V. of Mike Wood filed in IPR2016-00802, *Polygroup Limited (MCO)* v. *Willis Electric Co., Ltd.* on Apr. 28, 2016.
Declaration of Larina A. Alton filed in IPR2016-00802, *Polygroup Limited (MCO)* v. *Willis Electric Co., Ltd.* on Dec. 22, 2016.
Petition for Inter Partes Review for IPR2014-01263, *Polygroup Limited* v. *Willis Electric Co., Ltd.*, filed Aug. 8, 2014.
Patent Owner's Preliminary Response for IPR2014-01263, *Polygroup Limited* v. *Willis Electric Co., Ltd.*, filed Nov. 25, 2014.
Decision Denying Institution of Inter Partes Review for for IPR2014-01263, *Polygroup Limited* v. *Willis Electric Co., Ltd.*, filed Jan. 30, 2015.
Petition for Inter Partes Review for IPR2016-00800, *Polygroup Limited (MCO)* v. *Willis Electric Co., Ltd.*, filed Apr. 18, 2016.
Patent Owner's Preliminary Response for IPR2016-00800, *Polygroup Limited (MCO)* v. *Willis Electric Co., Ltd.*, filed Jul. 19, 2016.
Decision Granting Institution of Inter Partes Review for IPR2016-00800, *Polygroup Limited (MCO)* v. *Willis Electric Co., Ltd.*, filed Oct. 17, 2016.
Decision Granting Joint Motion Regarding Multiple Proceedings for IPR2016-00800, *Polygroup Limited (MCO)* v. *Willis Electric Co., Ltd.*, filed Feb. 15, 2017.
Termination of Trial Without Rendering Final Written Decision for IPR2016-00800, *Polygroup Limited (MCO)* v. *Willis Electric Co., Ltd.*, filed Feb. 28, 2016.
Petition for Inter Partes Review for IPR2016-01609, *Polygroup Limited (MCO)* v. *Willis Electric Co., Ltd.*, filed Sep. 2, 2016.
Patent Owner's Preliminary Response for IPR2016-01609, *Polygroup Limited (MCO)* v. *Willis Electric Co., Ltd.*, filed Dec. 8, 2016.
Decision Granting Joint Motion Regarding Multiple Proceedings for IPR2016-01609, *Polygroup Limited (MCO)* v. *Willis Electric Co., Ltd.*, filed Feb. 15, 2017.
Decision Ordering Consolidation of IPR2016-06109 with IPR2016-01610 for IPR2016-01609, *Polygroup Limited (MCO)* v. *Willis Electric Co., Ltd.*, filed Feb. 24, 2017.
Petition for Inter Partes Review for IPR2016-01610, *Polygroup Limited (MCO)* v. *Willis Electric Co., Ltd.*, filed Sep. 2, 2016.
Patent Owner's Preliminary Response for IPR2016-01610, *Polygroup Limited (MCO)* v. *Willis Electric Co., Ltd.*, filed Dec. 8, 2016.
Decision Granting Joint Motion Regarding Multiple Proceedings for IPR2016-01610, *Polygroup Limited (MCO)* v. *Willis Electric Co., Ltd.*, filed Feb. 15, 2017.
Decision Ordering Consolidation of IPR2016-06109 with IPR2016-01610 for IPR2016-01610, *Polygroup Limited (MCO)* v. *Willis Electric Co., Ltd.*, filed Feb. 24, 2017.
Decision Granting Institution of Inter Partes Review for IPR2016-01610, *Polygroup Limited (MCO)* v. *Willis Electric Co., Ltd.*, filed Feb. 27, 2017.
Petition for Inter Partes Review for IPR2014-01264, *Polygroup Limited* v. *Willis Electric Co., Ltd.*, filed Aug. 8, 2014.
Patent Owner's Preliminary Response for IPR2014-01264, *Polygroup Limited* v. *Willis Electric Co., Ltd.*, filed Nov. 25, 2014.
Decision Denying Institution of Inter Partes Review for IPR2014-01264, *Polygroup Limited* v. *Willis Electric Co., Ltd.*, filed Jan. 30, 2015.
Petition for Inter Partes Review for IPR2016-00801, *Polygroup Limited (MCO)* v. *Willis Electric Co., Ltd.*, filed Apr. 18, 2016.
Patent Owner's Preliminary Response for IPR2016-00801, *Polygroup Limited (MCO)* v. *Willis Electric Co., Ltd.*, filed Jul. 19, 2016.
Decision Granting Institution of Inter Partes Review for IPR2016-00801, *Polygroup Limited (MCO)* v. *Willis Electric Co., Ltd.*, filed Oct. 17, 2016.
Decision Granting Joint Motion Regarding Multiple Proceedings for IPR2016-00801, *Polygroup Limited (MCO)* v. *Willis Electric Co., Ltd.*, filed Feb. 15, 2017.
Termination of Trial Without Rendering Final Written Decision for IPR2016-00801, *Polygroup Limited (MCO)* v. *Willis Electric Co., Ltd.*, filed Feb. 28, 2017.
Petition for Inter Partes Review for IPR2016-01611, *Polygroup Limited (MCO)* v. *Willis Electric Co., Ltd.*, filed Nov. 2, 2016.
Patent Owner's Preliminary Response for IPR2016-01611, *Polygroup Limited (MCO)* v. *Willis Electric Co., Ltd.*, filed Dec. 7, 2016.
Decision Granting Joint Motion Regarding Multiple Proceedings for IPR2016-01611, *Polygroup Limited (MCO)* v. *Willis Electric Co., Ltd.*, filed Feb. 15, 2017.
Decision Ordering Consolidation of IPR2016-01611 with IPR2016-01612 for IPR2016-01611, *Polygroup Limited (MCO)* v. *Willis Electric Co., Ltd.*, filed Feb. 24, 2017.
Petition for Inter Partes Review for IPR2016-01612, *Polygroup Limited (MCO)* v. *Willis Electric Co., Ltd.*, filed Aug. 26, 2016.
Patent Owner's Preliminary Response for IPR2016-01612, *Polygroup Limited (MCO)* v. *Willis Electric Co., Ltd.*, filed Nov. 30, 2016.
Decision Granting Joint Motion Regarding Multiple Proceedings for IPR2016-01612, *Polygroup Limited (MCO)* v. *Willis Electric Co., Ltd.*, filed Feb. 15, 2017.
Decision Ordering Consolidation of IPR2016-01611 with IPR2016-01612 for IPR2016-01612, *Polygroup Limited (MCO)* v. *Willis Electric Co., Ltd.*, filed Feb. 24, 2017.
Decision Granting Institution of Inter Partes Review for IPR2016-01612, *Polygroup Limited (MCO)* v. *Willis Electric Co., Ltd.*, filed Feb. 24, 2017.
Petition for Inter Partes Review for IPR2016-01615, *Polygroup Limited (MCO)* v. *Willis Electric Co., Ltd.*, filed Sep. 2, 2016.
Patent Owner's Preliminary Response for IPR2016-01615, *Polygroup Limited (MCO)* v. *Willis Electric Co., Ltd.*, filed Dec. 9, 2016.
Decision Granting Institution of Inter Partes Review for IPR2016-01615, *Polygroup Limited (MCO)* v. *Willis Electric Co., Ltd.*, filed Feb. 27, 2017.
Patent Owner's Response for IPR2016-01615, *Polygroup Limited (MCO)* v. *Willis Electric Co., Ltd.*, filed May 22, 2017.
Petition for Inter Partes Review for IPR2016-01616, *Polygroup Limited (MCO)* v. *Willis Electric Co., Ltd.*, filed Sep. 13, 2016.
Patent Owner's Preliminary Response for IPR2016-01616, *Polygroup Limited (MCO)* v. *Willis Electric Co., Ltd.*, filed Dec. 30, 2016.
Decision Granting Institution of Inter Partes Review for IPR2016-01616, *Polygroup Limited (MCO)* v. *Willis Electric Co., Ltd.*, filed Feb. 27, 2017.
Patent Owner's Response for IPR2016-01616, *Polygroup Limited (MCO)* v. *Willis Electric Co., Ltd.*, filed May 22, 2017.
Petition for Inter Partes Review for IPR2016-01617, *Polygroup Limited (MCO)* v. *Willis Electric Co., Ltd.*, filed Sep. 2, 2016.
Patent Owner's Preliminary Response for IPR2016-01617, *Polygroup Limited (MCO)* v. *Willis Electric Co., Ltd.*, filed Dec. 9, 2016.
Decision Granting Institution of Inter Partes Review for IPR2016-01617, *Polygroup Limited (MCO)* v. *Willis Electric Co., Ltd.*, filed Feb. 27, 2017.
Patent Owner's Response for IPR2016-01617, *Polygroup Limited (MCO)* v. *Willis Electric Co., Ltd.*, filed May 22, 2017.
Petition for Inter Partes Review for IPR2016-01781, *Polygroup Limited (MCO)* v. *Willis Electric Co., Ltd.*, filed Sep. 13, 2016.
Patent Owner's Preliminary Response for IPR2016-01781, *Polygroup Limited (MCO)* v. *Willis Electric Co., Ltd.*, filed Feb. 21, 2017.
Decision Granting Institution of Inter Partes Review for IPR2016-01781, *Polygroup Limited (MCO)* v. *Willis Electric Co., Ltd.*, filed May 9, 2017.
Petition for Inter Partes Review for IPR2016-01782, *Polygroup Limited (MCO)* v. *Willis Electric Co., Ltd.*, filed Nov. 2, 2016.

(56) References Cited

OTHER PUBLICATIONS

Declaration of Mike Wood filed in IPR2016-00802, *Polygroup Limited (MCO)* v. *Willis Electric Co., Ltd.*, on Apr. 28, 2016.
Declaration of Ricky Tong filed in IPR2016-00802, *Polygroup Limited (MCO)* v. *Willis Electric Co., Ltd.*, on Dec. 30, 2016.
Declaration of Stuart Brown filed in IPR2016-00802, *Polygroup Limited (MCO)* v. *Willis Electric Co., Ltd.*, on Aug. 4, 2016.
C.V. of Mike Wood filed in IPR2016-06109 with IPR2016-01610, *Polygroup Limited (MCO)* v. *Willis Electric Co., Ltd.*, on Sep. 2, 2016.
Declaration of Johnny Chen filed in IPR2016-06109 with IPR2016-01610, *Polygroup Limited (MCO)* v. *Willis Electric Co., Ltd.*, on Dec. 8, 2016.
Declaration of Mike Wood filed in IPR2016-06109 with IPR2016-01610, *Polygroup Limited (MCO)* v. *Willis Electric Co., Ltd.*, on Sep. 2, 2016.
Declaration of Stuart Brown filed in IPR2016-06109 with IPR2016-01610, *Polygroup Limited (MCO)* v. *Willis Electric Co., Ltd.*, on Dec. 8, 2016.
C.V. of Mike Wood filed in IPR2016-01610, *Polygroup Limited (MCO)* v. *Willis Electric Co., Ltd.*, on Sep. 2, 2016.
Declaration of Ada Luk (redacted) filed in IPR2016-01610, *Polygroup Limited (MCO)* v. *Willis Electric Co., Ltd.*, on May 24, 2017.
Declaration of Beverly Rodgers filed in IPR2016-01610, *Polygroup Limited (MCO)* v. *Willis Electric Co., Ltd.*, on May 24, 2017.
Declaration of Bob Braasch filed in IPR2016-01610, *Polygroup Limited (MCO)* v. *Willis Electric Co., Ltd.*, on May 24, 2017.
Declaration of Brain Stone (redacted) Corrected filed in IPR2016-01610, *Polygroup Limited (MCO)* v. *Willis Electric Co., Ltd.*, on May 24, 2017.
Declaration of Emily Chen (Corrected) filed in IPR2016-01610, *Polygroup Limited (MCO)* v. *Willis Electric Co., Ltd.*, on May 24, 2017.
Declaration of Johnny Chen filed in IPR2016-01610, *Polygroup Limited (MCO)* v. *Willis Electric Co., Ltd.*, on Dec. 3, 2016.
Declaration of Johnny Chen (redacted) filed in IPR2016-01610, *Polygroup Limited (MCO)* v. *Willis Electric Co., Ltd.*, on May 24, 2017.
Declaration of Michael Sugar filed in IPR2016-01610, *Polygroup Limited (MCO)* v. *Willis Electric Co., Ltd.*, on May 24, 2017.
Declaration of Stuart Brown filed in IPR2016-01610, *Polygroup Limited (MCO)* v. *Willis Electric Co., Ltd.*, on Dec. 3, 2016.
Declaration of Stuart Brown in Support of Petition for Motion to Amend '186 Patent filed in IPR2016-01610, *Polygroup Limited (MCO)* v. *Willis Electric Co., Ltd.*, on May 24, 2017.
Declaration of Stuart Brown (Corrected) filed in IPR2016-01610, *Polygroup Limited (MCO)* v. *Willis Electric Co., Ltd.*, on Jun. 9, 2017.
Declaration of Johnny Chen filed in IPR2016-01611, *Polygroup Limited (MCO)* v. *Willis Electric Co., Ltd.*, on Dec. 7, 2016.
Declaration of Stuart Brown filed in IPR2016-01611, *Polygroup Limited (MCO)* v. *Willis Electric Co., Ltd.*, on Dec. 1, 2016.
Declaration of Ada Luk (redacted) filed in IPR2016-01612, *Polygroup Limited (MCO)* v. *Willis Electric Co., Ltd.*, on May 24, 2017.
Declaration of Beverly Rodgers filed in IPR2016-01612, *Polygroup Limited (MCO)* v. *Willis Electric Co., Ltd.*, on May 24, 2017.
Declaration of Bob Braasch filed in IPR2016-01612, *Polygroup Limited (MCO)* v. *Willis Electric Co., Ltd.*, on May 24, 2017.
Declaration of Emily Chen filed in IPR2016-01612, *Polygroup Limited (MCO)* v. *Willis Electric Co., Ltd.*, on May 24, 2017.
Declaration of Hal Poret filed in IPR2016-01612, *Polygroup Limited (MCO)* v. *Willis Electric Co., Ltd.*, on May 24, 2017.
Declaration of Johnny Chen (redacted) filed in IPR2016-01612, *Polygroup Limited (MCO)* v. *Willis Electric Co., Ltd.*, on May 24, 2017.
Declaration of Michael Sugar filed in IPR2016-01612, *Polygroup Limited (MCO)* v. *Willis Electric Co., Ltd.*, on May 24, 2017.
Declaration of Stuart Brown filed in IPR2016-01612, *Polygroup Limited (MCO)* v. *Willis Electric Co., Ltd.*, on Nov. 30, 2016.
Declaration of Stuart Brown filed in IPR2016-01612, *Polygroup Limited (MCO)* v. *Willis Electric Co., Ltd.*, on May 24, 2017.
Declaration of Stuart Brown in Support of Petition for Motion to Amend '187 Patent filed in IPR2016-01612, *Polygroup Limited (MCO)* v. *Willis Electric Co., Ltd.*, on May 24, 2017.
C.V. of Mike Wood filed in IPR2016-01613 filed in*Polygroup Limited (MCO)* v. *Willis Electric Co., Ltd.*, on Sep. 1, 2016.
Declaration of Johnny Chen filed in IPR2016-01613, *Polygroup Limited (MCO)* v. *Willis Electric Co., Ltd.*, on Dec. 9, 2016.
Declaration of Michael Sugar filed in IPR2016-01613, *Polygroup Limited (MCO)* v. *Willis Electric Co., Ltd.*, on May 30, 2017.
Declaration of Mike Wood filed in IPR2016-01613, *Polygroup Limited (MCO)* v. *Willis Electric Co., Ltd.*, on Sep. 1, 2016.
Declaration of Stuart Brown filed in IPR2016-01613, *Polygroup Limited (MCO)* v. *Willis Electric Co., Ltd.*, on Dec. 9, 2016.
Declaration of Stuart Brown filed in IPR2016-01613, *Polygroup Limited (MCO)* v. *Willis Electric Co., Ltd.*, on May 30, 2017.
Declaration of Stuart Brown in Support of Petition for Motion to Amend '056 Patent filed in IPR2016-01613, *Polygroup Limited (MCO)* v. *Willis Electric Co., Ltd.*, on May 30, 2017.
C.V. of Mike Wood filed in IPR2016-01615, *Polygroup Limited (MCO)* v. *Willis Electric Co., Ltd.*, on Sep. 2, 2016.
Declaration of Emily Chen filed in IPR2016-01615, *Polygroup Limited (MCO)* v. *Willis Electric Co., Ltd.*, on May 22, 2017.
Declaration of Johnny Chen filed in IPR2016-01615, *Polygroup Limited (MCO)* v. *Willis Electric Co., Ltd.*, on Dec. 9, 2016.
Declaration of Mike Wood filed in IPR2016-01615, *Polygroup Limited (MCO)* v. *Willis Electric Co., Ltd.*, on Sep. 2, 2016.
Declaration of Stuart Brown filed in IPR2016-01615, *Polygroup Limited (MCO)* v. *Willis Electric Co., Ltd.*, on Dec. 9, 2016.
Declaration of Stuart Brown filed in IPR2016-01615, *Polygroup Limited (MCO)* v. *Willis Electric Co., Ltd.*, on May 22, 2017.
Declaration of Stuart Brown in Support of Patent Owners Motion to Amend U.S. Pat. No. 8,936,379 filed in IPR2016-01615, *Polygroup Limited (MCO)* v. *Willis Electric Co., Ltd.*, on May 23, 2017.
C.V. of Mike Wood filed in IPR2016-01616, *Polygroup Limited (MCO)* v. *Willis Electric Co., Ltd.*, on Sep. 13, 2016.
Declaration of Emily Chen filed in IPR2016-01616, *Polygroup Limited (MCO)* v. *Willis Electric Co., Ltd.*, on May 22, 2017.
Declaration of Johnny Chen filed in IPR2016-01616, *Polygroup Limited (MCO)* v. *Willis Electric Co., Ltd.*, on Dec. 30, 2016.
Declaration of Stuart Brown filed in IPR2016-01616, *Polygroup Limited (MCO)* v. *Willis Electric Co., Ltd.*, on May 23, 2017.
Declaration of Stuart Brown in Support of Patent Owner's Motion to Amend U.S. Pat. No. 8,936,379 filed in IPR2016-01616, *Polygroup Limited (MCO)* v. *Willis Electric Co., Ltd.*, on May 23, 2017.
Declaration of Stuart Brown filed in IPR2016-01616, *Polygroup Limited (MCO)* v. *Willis Electric Co., Ltd.*, on Dec. 30, 2016.
C.V. of Mike Wood filed in IPR2016-01617, *Polygroup Limited (MCO)* v. *Willis Electric Co., Ltd.*, on Sep. 2, 2016.
Declaration of Emily Chen filed in IPR2016-01617, *Polygroup Limited (MCO)* v. *Willis Electric Co., Ltd.*, on May 22, 2017.
Declaration of Johnny Chen filed in IPR2016-01617, *Polygroup Limited (MCO)* v. *Willis Electric Co., Ltd.*, on Dec. 9, 2016.
Declaration of Mike Wood filed in IPR2016-01617, *Polygroup Limited (MCO)* v. *Willis Electric Co., Ltd.*, on Sep. 2, 2017.
Declaration of Stuart Brown filed in IPR2016-01617, *Polygroup Limited (MCO)* v. *Willis Electric Co., Ltd.*, on Dec. 9, 2016.
Declaration of Stuart Brown filed in IPR2016-01617, *Polygroup Limited (MCO)* v. *Willis Electric Co., Ltd.*, on May 22, 2017.
Declaration of Stuart Brown in Support of Patent Owner's Motion to Amend U.S. Pat. No. 8,936,379 filed in IPR2016-01617, *Polygroup Limited (MCO)* v. *Willis Electric Co., Ltd.*, on May 23, 2017.
C.V. of Mike Wood filed in Patent Owner's Preliminary Response for IPR2016-01781, *Polygroup Limited (MCO)* v. *Willis Electric Co., Ltd.*, on Nov. 2, 2016.
Declaration of Johnny Chen filed in Patent Owner's Preliminary Response for IPR2016-01781, *Polygroup Limited (MCO)* v. *Willis Electric Co., Ltd.*, on Feb. 21, 2017.
Declaration of Mike Wood filed in Patent Owner's Preliminary Response for IPR2016-01781, *Polygroup Limited (MCO)* v. *Willis Electric Co., Ltd.*, on Nov. 2, 2016.

(56) References Cited

OTHER PUBLICATIONS

Declaration of Stuart Brown filed in Patent Owner's Preliminary Response for IPR2016-01781, *Polygroup Limited (MCO)* v. *Willis Electric Co., Ltd.*, on Feb. 21, 2017.
C.V. of Mike Wood filed in IPR2016-01782, *Polygroup Limited (MCO)* v. *Willis Electric Co., Ltd.*, on Nov. 2, 2016.
Declaration of Johnny Chen filed in IPR2016-01782, *Polygroup Limited (MCO)* v. *Willis Electric Co., Ltd.*, on Feb. 21, 2017.
Declaration of Mike Wood filed in IPR2016-01782, *Polygroup Limited (MCO)* v. *Willis Electric Co., Ltd.*, on Nov. 2, 2016.
Declaration of Stuart Brown filed in IPR2016-01782, *Polygroup Limited (MCO)* v. *Willis Electric Co., Ltd.*, on on Feb. 21, 2017.
C.V. of Mike Wood filed in IPR2016-01783, *Polygroup Limited (MCO)* v. *Willis Electric Co., Ltd.*, on Nov. 2, 2016.
Declaration of Mike Wood filed in IPR2016-01783, *Polygroup Limited (MCO)* v. *Willis Electric Co., Ltd.*, on Nov. 2, 2016.
C.V. of Michael Lebby filed in IPR2017-00309, *Willis Electric Co., Ltd.* v. *Polygroup Macau Ltd. (BVI)*, on Mar. 13, 2017.
Declaration of Michael Lebby filed in IPR2017-00309, *Willis Electric Co., Ltd.* v. *Polygroup Macau Ltd. (BVI)*, on Mar. 13, 2017.
C.V. of Michael Lebby filed in IPR2017-00332, *Willis Electric Co., Ltd.* v. *Polygroup Macau Ltd. (BVI)*, on Mar. 8, 2017.
C.V. of William K. Durfee filed in IPR2017-00332, *Willis Electric Co., Ltd.* v. *Polygroup Macau Ltd. (BVI)*, on Nov. 24, 2016.
Declaration of Michael S. Lebby, Ph.D. filed in IPR2017-00332, *Willis Electric Co., Ltd.* v. *Polygroup Macau Ltd. (BVI)*, on Mar. 8, 2017.
Declaration of William Durfee filed in IPR2017-00332, *Willis Electric Co., Ltd.* v. *Polygroup Macau Ltd. (BVI)*, on Nov. 24, 2016.
C.V. of Michael Lebby filed in IPR2017-00331, *Willis Electric Co., Ltd.* v. *Polygroup Macau Ltd. (BVI)*, on Mar. 8, 2017.
Declaration of Michael Lebby, Ph.D. filed in IPR2017-00331, *Willis Electric Co., Ltd.* v. *Polygroup Macau Ltd. (BVI)*, on Mar. 8, 2017.
Declaration of William Durfee filed in IPR2017-00331, *Willis Electric Co., Ltd.* v. *Polygroup Macau Ltd. (BVI)*, on Nov. 24, 2016.
C.V. of Michael Lebby filed in IPR2017-00334, *Willis Electric Co., Ltd.* v. *Polygroup Macau Ltd. (BVI)*, on Mar. 13, 2017.
Declaration of Michael S. Lebby, Ph.D. filed in IPR2017-00334, *Willis Electric Co., Ltd.* v. *Polygroup Macau Ltd. (BVI)*, on Mar. 13, 2017.
Declaration of William Durfee filed in IPR2017-00334, *Willis Electric Co., Ltd.* v. *Polygroup Macau Ltd. (BVI)*, on Nov. 25, 2016.
C.V. of Michael Lebby filed in IPR2017-00335, *Willis Electric Co., Ltd.* v. *Polygroup Macau Ltd. (BVI)*, on Mar. 13, 2017.
Declaration of Michael S. Lebby, Ph.D. filed in IPR2017-00335, *Willis Electric Co., Ltd.* v. *Polygroup Macau Ltd. (BVI)*, on Mar. 13, 2017.
Declaration of William Durfee filed in IPR2017-00335, *Willis Electric Co., Ltd.* v. *Polygroup Macau Ltd. (BVI)*, on Nov. 25, 2016.
"Excerpt from Webster's New World Dictionary—'prong'," p. 1077, filed as Exhibit 1014 of IPR2017-00309 on Nov. 21, 2016, as Exhibit 1014 of IPR2017-00334 on Nov. 25, 2016, as Exhibit 1014 of IPR2017-00335 on Nov. 25, 2016, as Exhibit 1021 of IPR2017-00331 filed on Nov. 24, 2016, and as Exhibit 1021 of IPR2017-00332 on Nov. 25, 2016.
"Excerpt from Websters New Collegiate Dictionary—'prong'," p. 922, filed as Exhibit 1012 of IPR2017-00309 on Nov. 21, 2016, as Exhibit 1012 of IPR2017-00334 on Nov. 25, 2016, as Exhibit 1012 of IPR2017-00335 on Nov. 25, 2016, as Exhibit 1019 of IPR2017-00331 filed on Nov. 24, 2016, and as Exhibit 1019 of IPR2017-00332 on Nov. 25, 2016.
"Excerpt from the Oxford Dictionary—'prong'," p. 979, filed as Exhibit 1015 of IPR2017-00309 on Nov. 21, 2016, as Exhibit 1015 of IPR2017-00334 on Nov. 25, 2016, as Exhibit 1015 of IPR2017-00335 on Nov. 25, 2016, as Exhibit 1022 of IPR2017-00331 filed on Nov. 24, 2016, and as Exhibit 1022 of IPR2017-00332 on Nov. 25, 2016.
"Excerpt from the American Heritage Dictionary—'prong'," p. 191-192, filed as Exhibit 1013 of IPR2017-00309 on Nov. 21, 2016, as Exhibit 1013 of IPR2017-00334 on Nov. 25, 2016, as Exhibit 1013 of IPR2017-00335 on Nov. 25, 2016, as Exhibit 1020 of IPR2017-00331 filed on Nov. 24, 2016, and as Exhibit 1020 of IPR2017-00332 on Nov. 25, 2016.
"Excerpt from Wiley Electrical and Electronics Engineering Dictionary—'Wiring Harness'," p. 866, filed as Exhibit 1046 of IPR2016-00800 on Apr. 18, 2016, Exhibit 1044 of IPR2016-00802 on Apr. 28, 2016, Exhibit 1044 of IPR2016-01613 on Sep. 1, 2016, Exhibit 1017 of IPR2016-01615 on Sep. 2, 2016, Exhibit 1017 of IPR2016-01616 on Sep. 13, 2016, and Exhibit 1017 of IPR2016-01617 on Sep. 2, 2016.
"Excerpt from Wiley Electrical and Electronics Engineering Dictionary—'Wire Harness'," p. 864, filed as Exhibit 1045 of IPR2016-00800 on Apr. 18, 2016, Exhibit 1043 of IPR2016-00802 on Apr. 28, 2016, Exhibit 1043 of IPR2016-01613 on Sep. 1, 2016, Exhibit 1016 of IPR2016-01615 on Sep. 2, 2016, Exhibit 1016 of IPR2016-01616 on Sep. 13, 2016, and Exhibit 1016 of IPR2016-01617 on Sep. 2, 2016.
"Excerpt from Wiley Electrical and Electronics Engineering Dictionary—'terminal block'," p. 781, filed as Exhibit 1048 of IPR2016-01613 on Sep. 1, 2016.
"Excerpt from Wiley Electrical and Electronics Engineering Dictionary—'hub'," p. 351, filed as Exhibit 1047 of IPR2016-01613 on Sep. 1, 2016.
"Excerpt from Wiley Electrical and Electronics Engineering Dictionary—'electrical'," p. 233, filed as Exhibit 1046 of IPR2016-01613 on Sep. 1, 2016.
"Excerpt from Webster's New Collegiate Dictionary," p. 884, filed as Exhibit 2013 of IPR2016-01610 on Dec. 8, 2016 and Exhibit 2009 of IPR2016-01612 on Nov. 30, 2016.
"Excerpt from the American Heritage Dictionary," p. 690, filed as Exhibit 2006 of IPR2016-01781 on Feb. 21, 2017, filed as Exhibit 2006 of IPR2016-01782 on Feb. 21, 2017.
"Excerpt from Oxford Pocket Dictionary—'port'," encyclopedia.com, filed as Exhibit 2007 of IPR2016-01616 on Dec. 30, 2016.
"Excerpt from McGraw-Hill Dictionary of Scientific and Technical Terms—'clip'," p. 386-387, filed as Exhibit 1047 of IPR2016-800 on Apr. 18, 2016 and as Exhibit 1057 of IPR2016-01610 on Feb. 21, 2017.
Infringement Claim Charts Exhibit A-4 from *Polygroup Macau Ltd. (BVI)* v. *Willis Electric Co., Ltd.*, U.S. Pat. No. 6,794,825—Blue Twinkle Representative Tree for IPR2017-00330 filed Nov. 24, 2016.
Infringement Claim Charts Exhibit A-1 from *Polygroup Macau Ltd. (BVI)* v. *Willis Electric Co., Ltd.*, U.S. Pat. No. 6,794,825—Diamond Peak Tree for IPR2017-00330 filed Nov. 24, 2016.
Infringement Claim Charts Exhibit A-2 from *Polygroup Macau Ltd. (BVI)* v. *Willis Electric Co., Ltd.*, U.S. Pat. No. 6,794,825—Seneca Pine for IPR2017-00330 filed Nov. 24, 2016.
Infringement Claim Charts Exhibit A-3 from *Polygroup Macau Ltd. (BVI)* v. *Willis Electric Co., Ltd.*, U.S. Pat. No. 6,794,825—Slim Blue Twinkle for IPR2017-00330 filed Nov. 24, 2016.
Infringement Claim Charts Exhibit A-5 from *Polygroup Macau Ltd. (BVI)* v. *Willis Electric Co., Ltd.*, U.S. Pat. No. 6,794,825—Spruce Quickset for IPR2017-00330 filed Nov. 24, 2016.
Infringement Claim Charts Exhibit A-6 from *Polygroup Macau Ltd. (BVI)* v. *Willis Electric Co., Ltd.*, U.S. Pat. No. 6,794,825—Sylvania Color Changing for IPR2017-00330 filed Nov. 24, 2016.
Infringement Claim Charts Exhibit A-7 from *Polygroup Macau Ltd. (BVI)* v. *Willis Electric Co., Ltd.*, U.S. Pat. No. 6,794,825—Yukon Spruce for IPR2017-00330 filed Nov. 24, 2016.
Patent Owner's Infringement Claim Charts Exhibit D-4 from *Polygroup Macau Ltd. (BVI)* v. *Willis Electric Co., Ltd.*, Case No. 3:15-cv-552 (W.D.N.C. ) for IPR2017-00309 filed Nov. 21, 2016.
"Complaint in the matter of *Polygroup* v. *Willis Electric*, Civil Action No. 3:15-cv-552," filed as Exhibit 1009 of IPR2017-00330 on Nov. 24, 2016.
"First Amended Complaint, Civil Action No. 3:15-cv-552," filed as Exhibit 1010 of IPR2017-00330 on Nov. 24, 2016.
"Answer and Counterclaims, Civil Action No. 3:15-cv-552," filed as Exhibit 1011 of IPR2017-00330 on Nov. 24, 2016.
"First Amended Answer and Counterclaims, Civil Action No. 3:15-cv-552," filed as Exhibit 1012 of IPR2017-00330 on Nov. 24, 2016.

(56) References Cited

OTHER PUBLICATIONS

"Second Amended Complaint, Civil Action No. 3:15-cv-552," filed as Exhibit 1013 of IPR2017-00330 on Nov. 24, 2016.
"Second Amended Answer and Counterclaims, Civil Action No. 3:15-cv-552," filed as Exhibit 1014 of IPR2017-00330 on Nov. 24, 2016.
Transcript of deposition of Mike Wood on Jan. 5, 2017, *Polygroup Limited (MCO)*, Petitioner, vs. *Willis Electric Co, LTD*, Patent Owner, before the Patent and Trial Appeal Board for cases IPR2016-00800, IPR2016-00801, IPR2016-00802.
Transcript of deposition of Mike Wood on Apr. 19, 2017, *Polygroup Limited (MCO)*, Petitioner, vs. *Willis Electric Co, LTD*, Patent Owner, before the Patent and Trial Appeal Board for cases IPR2016-00800, IPR2016-00801, IPR2016-00802, IPR2016-01615.
Exhibit 2—Excerpt from Webster's New World Dictionary, Third College Edition, p. 22, from deposition of Mike Wood on Jan. 5, 2017, *Polygroup Limited (MCO)*, Petitioner, vs. *Willis Electric Co, LTD*, Patent Owner, before the Patent and Trial Appeal Board for cases IPR2016-00800, IPR2016-00801, IPR2016-00802.
Exhibit 3—Excerpt from American Heritage dictionary p. 690, from deposition of Mike Wood on Jan. 5, 2017, *Polygroup Limited (MCO)*, Petitioner, vs. *Willis Electric Co, LTD*, Patent Owner, before the Patent and Trial Appeal Board for cases IPR2016-00800, IPR2016-00801, IPR2016-00802.
2012 Polygroup, 7.5 foot Pre-Lit Wesley, filed on May 24, 2017 in IPR2016-01610 as Paper No. 2182, and in IRP2016-01612 as Paper No. 2169.
2012 Polygroup, 9 foot Pre-Lit Wesley, filed on May 24, 2017 in IPR2016-01610 as Paper No. 2183, and in IRP2016-01612 as Paper No. 2170.
2012 Polygroup, 9 foot Pre-Lit Slim, filed on May 24, 2017 in IPR2016-01610 as Paper No. 2185, and in IRP2016-01612 as Paper No. 2172.
2012 Polygroup Englewood Spruce, 7.5 feet, filed on May 24, 2017 in IPR2016-01610 as Paper No. 2184, and in IRP2016-01612 as Paper No. 2171.
2013 Polygroup Sams Club 7 foot Prelit Camden Fir, filed on May 24, 2017 in IPR2016-01610 as Paper No. 2186, and in IRP2016-01612 as Paper No. 2173.
2013 Polygroup Group III LED 7.5 foot Prelit Fir, filed on May 24, 2017 in IPR2016-01610 as Paper No. 2188, and in IRP2016-01612 as Paper No. 2175.
2015 Polygroup Group 1 9 foot Prelit Pine, filed on May 24, 2017 in IPR2016-01610 as Paper No. 2187, and in IRP2016-01612 as Paper No. 2174.
2015 Polygroup Lowes 7.5 foot Hayden Pine, filed on May 24, 2017 in IPR2016-01610 as Paper No. 2189, and in IRP2016-01612 as Paper No. 2176.
2015 Polygroup Walmart 7.5 foot Kennedy Fir, filed on May 24, 2017 in IPR2016-01610 as Paper No. 2190, and in IRP2016-01612 as Paper No. 2177.
2016 6.5 foot Vancouver Fir, filed on May 24, 2017 in IPR2016-01610 as Paper No. 2192, and in IRP2016-01612 as Paper No. 2179.
2016 7.5 foot Cashmere Pine, filed on May 24, 2017 in IPR2016-01610 as Paper No. 2193, and in IRP2016-01612 as Paper No. 2180.
2016 7.5 foot Prescott, filed on May 24, 2017 in IPR2016-01610 as Paper No. 2195, and in IRP2016-01612 as Paper No. 2182.
2016 9 foot Williams Pine, filed on May 24, 2017 in IPR2016-01610 as Paper No. 2194, and in IRP2016-01612 as Paper No. 2181.
2016 Duncan Fir, filed on May 24, 2017 in IPR2016-01610 as Paper No. 2198, and in IRP2016-01612 as Paper No. 2185.
2016 Kennedy Fir Pre Lit, filed on May 24, 2017 in IPR2016-01610 as Paper No. 2199, and in IRP2016-01612 as Paper No. 2186.
2016 Kimberly Pine, filed on May 24, 2017 in IPR2016-01610 as Exhibit No. 2199, and in IRP2016-01612 as Exhibit No. 2186.
Alexander Pine, filed on May 24, 2017 in IPR2016-01610 as Exhibit No. 2210, and in IRP2016-01612 as Exhibit No. 2197.
Denison Spruce, filed on May 24, 2017 in IPR2016-01610 as Exhibit No. 2205, and in IRP2016-01612 as Exhibit No. 2192.
Slim Wesley, filed on May 24, 2017 in IPR2016-01610 as Exhibit No. 2207, and in IRP2016-01612 as Exhibit No. 2194.
Splendor Spruce, filed on May 24, 2017 in IPR2016-01610 as Exhibit No. 2208, and in IRP2016-01612 as Exhibit No. 2195.
U.S. Appl. No. 13/659,737, filed Oct. 24, 2012 (now U.S. Pat. No. 8,863,416).
U.S. Appl. No. 14/621,507, filed Feb. 13, 2015 (now U.S. Patent No. 9,119,495).
U.S. Appl. No. 13/112,650, filed May 20, 2011 (now U.S. Pat. No. 8,454,186).
U.S. Appl. No. 13/240,668, filed Sep. 22, 2011 (now U.S. Pat. No. 8,936,379).
U.S. Appl. No. 13/461,432, filed May 1, 2012 (now U.S. Pat. No. 8,454,187).
U.S. Appl. No. 13/663,135, filed Oct. 29, 2012 (now U.S. Patent No. 9,066,617).
U.S. Appl. No. 13/718,028, filed Feb. 18, 2012 (now U.S. Pat. No. 8,974,072).
U.S. Appl. No. 13/836,026, filed Mar. 15, 2013 (now U.S. Patent No. 9,044,056).
7.5' Wesley Pine Pre-Lit Christmas Tree sold by Polygroup to Home Depot in 2008—Bates No. POLY_MN_00068515-00068523; POLY_MN_00068624-00068626; POLY_MN_00068656-00068663, 20 pages.
7.5' Madison Pine Pre-Lit Christmas Tree sold by Polygroup to Kmart in 2008—Bates No. POLY_MN_00068515-00068518; POLY_MN_00068558-00068559; POLY_MN_00068575-00068585; POLY_MN_00068561-00068564; POLY_MN_00068628-00068649; POLY_MN_00068624-00068626; POLY_MN_00068656-00068663, 54 pages.
Pre-Lit Holiday Time Douglas Fir sold by Inliten in 2008—Bates No. POLY_MN_00068528-0068552, 25 pages.
Bethlehem Light Pre-Lit Christmas Tree sold by QVC in 2010—Bates No. POLY_MN_00068591-00068623, 33 pages.
Search Report in related French Application No. FR1260233, dated Oct. 1, 2015.
Search Report in related British Patent Application No. GB1219319.9, dated Jan. 7, 2013.
Search Report from Related British Patent Application No. GB1602223.8, dated Mar. 22, 2016, 5 pages.
File history of U.S. Appl. No. 10/294,088, filed Nov. 14, 2002 (now U.S. Pat. No. 6,794,825).
Declaration of Brain Stone filed in IPR2016-01612, *Polygroup Limited (MCO)* v. *Willis Electric Co., Ltd.* on May 24, 2017.
Declaration of William K. Durfee, Ph.D., filed in IPR2017-00309, *Willis Electric Co., Ltd.* V. *Polygroup Macau Ltd. (BVI)*, on Nov. 21, 2016.
C.V. of Michael S. Lebby, Ph.D. filed in IPR2017-00332, *Willis Electric Co., Ltd.* V. *Polygroup Macau Ltd. (BVI)* on Mar. 8, 2017.
Mosdesign Semi. M80056B Light Controller (May 14, 2002), filed on Nov. 24, 2016 in IPR2017-00330 as Exhibit No. 1024.
Robert S. Mroczkowski "A Perspective on Connector Reliability" 50th IEEE Holm Conference on Electrical Contacts at Sheraton Hotel, Seattle, Washington USA Sep. 20-23, 2004.
J. Swingler, J.W. McBride, C. Maul "Degradation of road tested automotive connectors", IEEE Transactions on Components and Packaging Technologies, vol. 23, issue 1, pp. 157-164 Mar. 2000 (Abstract only).
R.S. Mroczkowski, J.M. Maynard "Extimating the reliability of electrical connectors", IEEE Transactions on Reliability, vol. 40, issue 5, pp. 507-512, Dec. 1991 (Abstract only).
Holtek HT2040A Christmas Light Controller (Mar. 26, 1997), filed on Nov. 24, 2016 in IPR2017-00330 as Exhibit No. 1023.
Mouser Electronics, Purchasing Manuel 592, 3 pages.
Robert S. Mroczkowski, Electronic Connector Handbook, Theory and Applications, McGraw-Hill., 1998, 12 pages.
U.S. Appl. No. 13/288,114, filed Nov. 3, 2011.
"Electronic Connector Reliability", avaliable at http://www.thomasnet.com/articles/automation-electronics/reliabilityalectronic-connectors on or before Jan. 7, 2011.
U.S. Appl. No. 90/020,074, filed Jul. 14, 2014.
U.S. Appl. No. 90/020,073, filed Jul. 7, 2014.
U.S. Appl. No. 61/643,968, filed May 8, 2012.
U.S. Appl. No. 61/385,751, filed Sep. 23, 2010.
U.S. Appl. No. 61/552,944, filed Oct. 28, 2011.

MULTI-WIRE QUICK ASSEMBLE TREE

CROSS-REFERENCE TO RELATED APPLICATION AND PRIORITY CLAIM

This application is a continuation application of U.S. patent application Ser. No. 15/081,067, filed 25 Mar. 2016, entitled "MULTI-WIRE QUICK ASSEMBLE TREE," now allowed, which claims the benefit under 35 U.S.C. § 119(e) of U.S. Provisional Patent Application No. 62/139,046, filed 27 Mar. 2015, the entire contents and substance of which are incorporated herein by reference in their entirety.

FIELD OF THE DISCLOSURE

Embodiments of the present disclosure relate generally to power transfer systems, and, more particularly, to power transfer systems for use with artificial trees, such as artificial Christmas trees.

BACKGROUND

As part of the celebration of the Christmas season, many people traditionally bring a pine or evergreen tree into their home and decorate it with ornaments, lights, garland, tinsel, and the like. Natural trees, however, can be quite expensive and are recognized by some as a waste of environmental resources. In addition, natural trees can be messy, leaving both sap and needles behind after removal, and requiring water to prevent drying out and becoming a fire hazard. Each time a natural tree is obtained it must be decorated, and at the end of the Christmas season the decorations must be removed. Because the needles have likely dried and may be quite sharp by this time, removal of the decorations can be a painful process. In addition, natural trees are often disposed in landfills, further polluting these overflowing environments.

To overcome the disadvantages of a natural Christmas tree, yet still incorporate a tree into the holiday celebration, a variety of artificial Christmas trees are available. For the most part, these artificial trees must be assembled for use and disassembled after use. Artificial trees have the advantage of being usable over a period of years and thereby eliminate the annual expense of purchasing live trees for the short holiday season. Further, they help reduce the chopping down of trees for a temporary decoration, and the subsequent disposal, typically in a landfill, of same.

Generally, artificial Christmas trees comprise a multiplicity of branches each formed of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of the branch, the most common form of artificial Christmas tree comprises a plurality of trunk sections connectable to one another. For example, in many designs, a first and second trunk section each comprise an elongate body. A first end of the body includes a receiving portion (e.g., a female end) and a second end of the body includes an extending portion (e.g., a male end). Typically, the body is a cylinder. Near the second end the body tapers slightly to reduce the diameter of the body. In other words, the diameter of the first end, i.e., the receiving portion, is larger than the diameter of the second end, i.e., the extending portion. To connect the trunk sections, the first end of a first trunk sections receives the second end of a second trunk sections. For example, the tapered end of the first trunk section is inserted into the non-tapered end of the second trunk section. In this manner, a plurality of trunk sections can be connected and a tree assembled.

One difficulty encountered during assembly, however, is the rotational alignment of the trunk sections. In some designs, the trunk sections comprise electrical systems. The electrical systems allow electricity to flow through the trunk of the tree and into accessories that can extend from the trunk or that can be plugged into outlets disposed on the trunk. To connect neighboring trunk sections, however, electrical prongs of one trunk section must be rotationally aligned with, and inserted into, electrical slots in another trunk section. This alignment process can be frustrating because it can be difficult for a user to judge whether the prongs will engage the slots when trunk sections are joined together. It may therefore take several attempts before a user can electrically connect two trunk sections.

Further, consumers often desire options for lighting combinations that go beyond traditional white or multicolored string lights. Customers desire artificial trees that can emit thousands of light combinations. In addition to the light combinations, customers also desire trees that are backlit with white lights that help amplify the light combinations and give the overall tree a pleasing glow that supplements the light combinations.

What is needed, therefore, is a power transfer system for an artificial tree that supports various light designs and implementations and that allows a user to connect neighboring tree trunk sections without the need to rotationally align the trunk sections. Embodiments of the present disclosure address this need as well as other needs that will become apparent upon reading the description below in conjunction with the drawings.

SUMMARY

Briefly described, embodiments of the presently disclosed subject matter generally relate to power transfer systems, and, more particularly, to power transfer systems for use with artificial trees, such as artificial Christmas trees.

Aspects of the present disclosure relate to a power transfer system that provides at least four electrical contacts and allows for near 360° alignment between male and female ends of artificial Christmas tree trunk sections that are to be joined. For example, a power transfer system according to the present disclosure can be used with LED light strings that comprise LED lamps with four inputs. In some embodiments, the LEDs may be single color, but in other embodiments, the LEDs may be multicolor (e.g., RGB LEDs). In some embodiments, the power transfer system may include six electrical contacts such that the power transfer system can be used with LED light strings in addition to conventional light strings with two inputs. In addition to electrical prongs (in the male end) and contact devices (in the female end), the respective male and female ends also include clutch elements that in aligning the male and female ends when a user joins them. Further, the clutch elements help maintain rotational alignment once the male and female ends have been joined.

In some examples, embodiments relate to power transfer systems with four electrical contacts. In some embodiments, the power transfer system comprises two artificial tree trunk sections, one having a male end and the other having a female end. For example, in some embodiments, the female end may comprise four electrically isolated contact devices.

The contact devices of the female end may include a central contact device disposed proximate the center of a central receiving void of a female end base. Further, the contact devices of the female end may include a first channel contact device disposed proximate the exterior of a female end base extension. The female end may further comprise an outer wall, and second and third channel contact devices may be disposed on the interior surface of the outer wall.

Additionally, in some examples, the male end may comprise four electrical prongs for electrical connection with the female end and to allow for electrical communication between the male and female ends. In some embodiments, the male end may comprise a center male terminal prong as well as first, second, and third channel male terminal prongs. In some embodiments, the center male terminal may be adapted to contact the central contact device, and the first, second, and third channel male terminal prongs may be adapted to contact the first, second, and third channel contact devices of the female end. When the prongs and contact devices come into contact (i.e., when the male and female ends are joined together), it can create a power distribution system. In some embodiments, this power distribution system can be used to power LED light strings (e.g., LED light strings that comprise RGB LED lamps or single-color LED lamps). As will be appreciated, LED lamps typically comprise four leads: one for electronic signal input, one for electronic signal output, and two for power (e.g., AC supply voltage). The four-contact design of the present disclosure can be used in conjunction with such LED light strings. Also, in some embodiments, the electrical isolation of the contacts allows for 360° or near-360° compatibility between the male and female ends. In other words, when joining the male and female ends, a user is not required to pre-align the ends because electrical communication can be achieved between the prongs and contacts irrespective of the rotational alignment.

In some embodiments, the male and female ends may comprise radially extending clutch elements. These clutch elements may comprise sloped or angled top surfaces (i.e., the clutch elements may comprise a first and second height and a top surface that angles from the first height to the second height). Further, in some embodiments, the top surface may comprise a plurality of facets. In some embodiments, these facets may be configured such that they angle away from one another (e.g., similar to the roof of a house) or, put differently, that extend radially and angle circumferentially downward. Thus, because of the configuration of the clutch elements in some embodiments, when the male end and female end are brought together, the opposing male and female clutch elements can easily disengage from one another, thereby making it simple for a user to join the male and female ends. Further, once the male and female ends of been joined to form a power distribution system, the clutch elements may prevent the male and female ends from rotating relative to one another, thus helping to maintain electrical communication and keeping the trunk sections aligned in the user's desired configuration.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
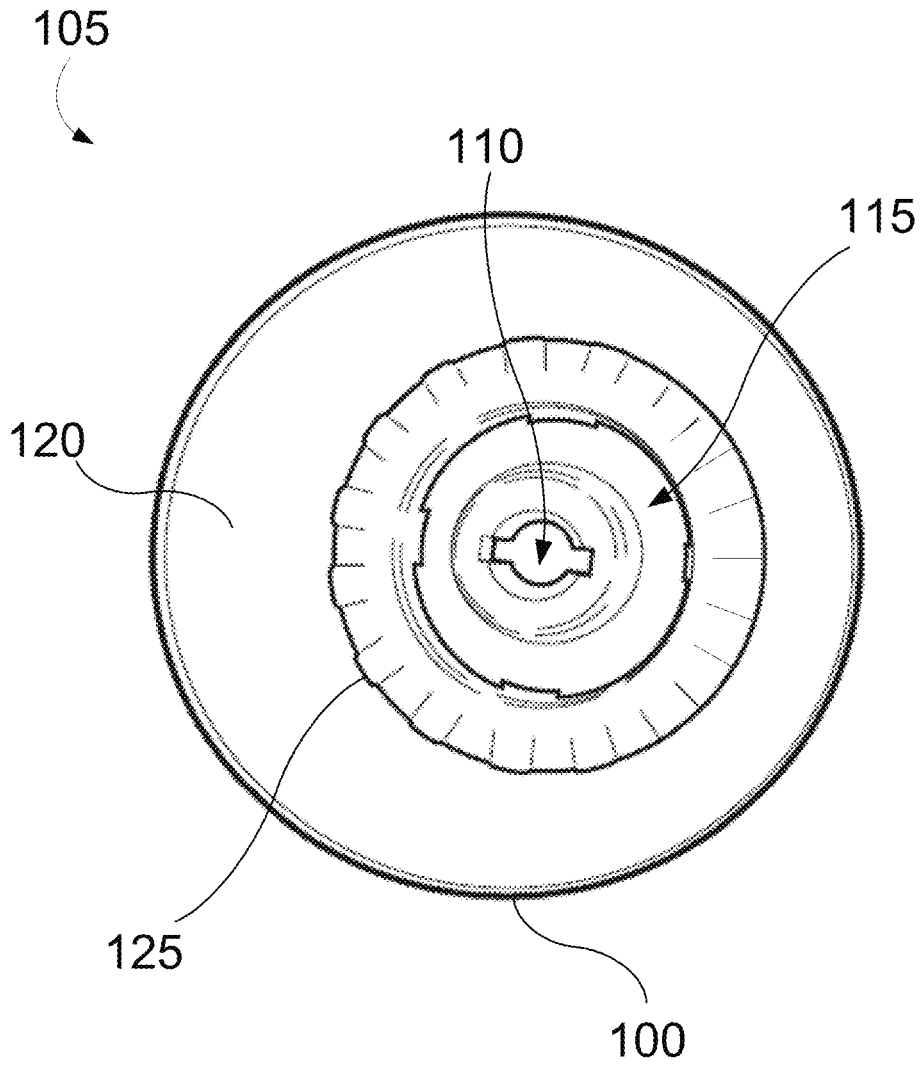
FIG. 1 depicts a perspective view of a female end of a tree trunk section, in accordance with some embodiments of the present disclosure.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

To facilitate an understanding of the principles and features of the disclosure, various illustrative embodiments are explained below. In particular, the presently disclosed subject matter is described in the context of being an artificial tree power system. The present disclosure, however, is not so limited, and can be applicable in other contexts. For example and not limitation, some embodiments of the present disclosure may improve other power systems, such as light poles, lamps, extension cord systems, power cord connection systems, and the like. These embodiments are contemplated within the scope of the present disclosure. Accordingly, when the present disclosure is described in the context of a power transfer system for an artificial Christmas tree, it will be understood that other embodiments can take the place of those referred to.

When assembling an artificial tree, decorators commonly desire to illuminate the tree with one or more light strings, i.e., strands of lights. The light strings require electrical power and are conventionally connected in series. In many designs, at least one of the light strings is connected to a wall outlet to provide power to all of the light strings. When decorating a tree, the decorator can walk around the tree, placing the light strings on various locations on the branches of the tree. In order to provide power to all of the light strings, typical light strings come with a first end in the form of a male end and a second end in the form of a female end.

To provide power to more than one light string, the decorator can insert the male end of one light string into the female end of another light string. In doing so, the light string that is electrically connected to a wall outlet (or other power outlet) transfers electrical energy from the outlet to subsequent light strings. In some conventional systems, the lights strings can have multiple points of electrical connectivity, providing for parallel or serial connectivity. Even so, the flow of power is usually from one light string connected to the power outlet to one or more downstream light strings.

The act of providing power from the outlet to one or more light strings can be cumbersome and frustrating for a decorator. In order to attach multiple light strings together, the decorator will either need to attach the light strings prior to their placement on the tree or attach the light strings after they have been placed on the tree. If the decorator attaches multiple light strings together, in order to "wrap" the tree with the light strings, the decorator often must walk around the tree, carrying the multiple strings. If the decorator waits until after the light strings are placed on the tree, the decorator will need to reach through the tree branches and electrically connect the light strings. The decorator would also likely need to manipulate the light strings in order to connect the strings together. This process can be difficult and can take an extended amount of time.

To alleviate issues associated with providing power to light strings in conventional artificial trees, and to provide further advantages, the present disclosure comprises a power transfer system for an artificial tree. In an exemplary embodiment, an artificial tree trunk comprises tree trunk sections that are engaged with one another to form the trunk of an artificial tree. At least some of the tree trunk sections can have hollow voids. Within the hollow voids can be components of power distribution systems. In some embodiments, a female end or a male end is located proximate the end of the tree trunk sections. For example, a tree trunk section could have a male end on one end and a female end on the other end. Or, a tree trunk section could have male ends or female ends on both ends. In some embodiments, when one tree trunk section is engaged with another tree trunk section, the male end engages with and is electrically connected to the female end to form a power distribution system, which may be a subcomponent of an overall power distribution system. Thus, by electrically connecting a power distribution system of a tree trunk section to a power outlet, electrical power flows from the outlet to those combined tree trunk sections and can also flow from those trunk sections to other tree trunk sections.

A variety of systems exist to facilitate joining the male and female ends to form a power distribution system. Although conventional plug and outlet systems can be used, such as those manufactured in accordance with NEMA standards, in some cases, it can be difficult in conventional designs to align the male prongs of one tree trunk section with the female holes of another tree trunk section. In order to engage the male end with the female end, the assembler of the tree often must vertically align the tree trunk sections so that the male prongs of the male end are not angled to the female end in a manner that prevents insertion of the male prongs. The assembler must also rotationally align the two tree trunk sections to allow the prongs to line up with the female holes. Even if the tree trunk sections are perfectly vertical, in conventional systems, the male prongs can only engage the female holes if the male prongs are rotationally aligned with the female holes. If not, the male prongs abut the area around the female holes, which prevents insertion of the male prongs. Attempting to align the male prongs and the female holes can therefore take significant time and effort, and can be a frustrating experience for a user.

To alleviate this problem, in one embodiment, the present disclosure comprises a female end having a central void for receiving a first male prong of the male end and a channel void disposed around the central void for receiving a second male prong. In this configuration, the assembler of the tree trunk sections can be less concerned with the rotational, or angular, displacement of the two tree trunk sections, as the channel provides for engagement with the male end at various angular displacements. In exemplary embodiments, the channel is disposed 360 degrees around the central void so that, regardless of the angular displacement between the tree trunk sections, the male prongs can engage the female voids. This can make the assembly process much easier and more enjoyable for a user. Further, in some embodiments, the power distribution system formed between the male and female ends may comprise four electrical contacts. Thus, embodiments of the present disclosure may provide a power distribution system that can be used with LED light strings that comprise, for example, RGB LED lamps that require four contacts (two for AC supply voltage, one for electronic signal input, and one for electronic signal output).

Embodiments of the present disclosure can also be used in a variety of systems. For example, some embodiments can be used in low voltage systems, and other embodiments can be used in normal, higher voltage systems.

Referring now to the figures, wherein like reference numerals represent like parts throughout the views, exemplary embodiments will be described in detail.

FIG. 1 depicts an exemplary embodiment of a female end 105 of a power distribution system of a tree trunk section 100. In some embodiments, female end 105 can have one or more electrical voids for receiving power from, or distributing power to, a male end of a power distribution system of a tree trunk section. Female end 105 can comprise central receiving void 110 for engaging with a prong of a male end and channel receiving void 115 for engaging with another prong of a male end.

In some embodiments, the voids 110, 115 can be hollows or apertures that receive and engage with other electrical connectors, such as prongs, and enable the electrical connectors to conduct electrical power through the trunk of the tree. In some embodiments, the central receiving void 110 can be located proximate the center of the female end 105. The channel receiving void 115, therefore, can be a round or circular channel that encircles the central receiving void 110. Accordingly, the central receiving void 110 can be located proximate the center of the channel receiving void 115.

Figure 2:
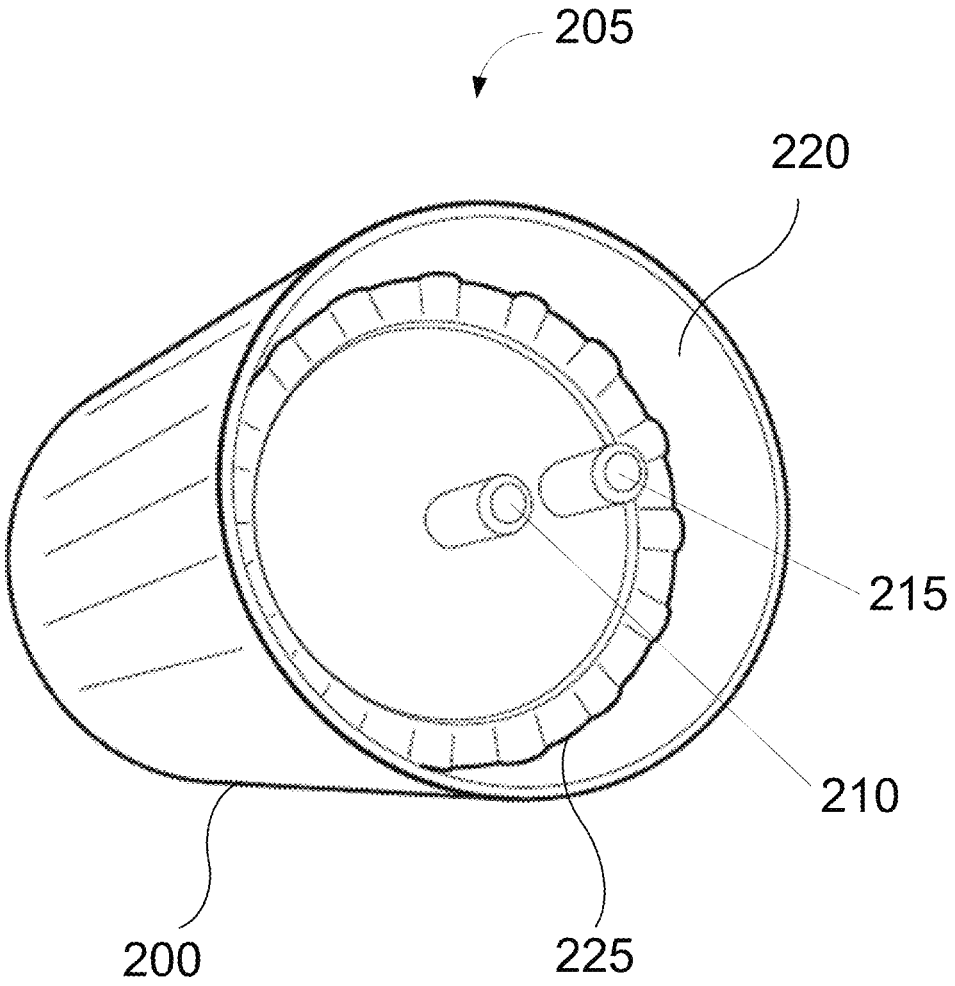
FIG. 2 depicts a perspective view of a male end of a tree trunk section, in accordance with some embodiments of the present disclosure.

FIG. 2 depicts an exemplary embodiment of a male end 205 of a power distribution system of a tree trunk section. In some embodiments, male end 205 can have one or more prongs for receiving power from, or distributing power to, a female end 105 of a power distribution system of a tree trunk section. In some embodiments, the male end 205 comprises two prongs. A first prong can provide a "positive" flow path for electricity and a second prong can provide a "negative" flow path for electricity.

As shown in FIG. 2, male end 205 can have a central male prong 210 and a channel male prong 215. In some embodiments, central male prong 210 can be sized and shaped to fit inside of and engage central receiving void 110, and channel male prong 215 can be sized and shaped to fit inside of and engage channel receiving void 115. In some embodiments, when central male prong 210 and channel male prong 215 of the male end 205 are inserted into the central receiving void 110 and channel receiving void 115 of the female end 105, respectively, electrical power can be conducted from male end 205 to female end 105, or vice versa, depending on the direction of electrical power flow. In this manner, electrical power can be conducted from a first power distribution system to a second power distribution system.

As shown in FIGS. 1 and 2, by having channel receiving void 115 disposed in a circular manner around central receiving void 110 of female end 105, assembly issues concerning the angular relationship (i.e., rotational alignment) of male end 205 and female end 105 can be reduced or eliminated. In other words, central male prong 210 can be located in the center of the male end 205, and central receiving void 210 can be located in the center of female end 105, enabling central male prong 210 and central receiving void 210 to line up regardless of the rotational alignment of the male end 205 and female end 105. In addition, channel male prong 215 of male end 205 can be inserted at a plurality of locations along channel receiving void 115 of female end 105, and still establish and maintain electrical connectivity between female end 105 and male end 205. More particularly, the channel prong 215 can engage the channel receiving void 115 in a plurality of configurations, and each configuration can provide a different rotational alignment between the two trunk sections (i.e., 100 and 200). This design enables the male end 205 and the female end 105 to electrically engage regardless of the angular relationship, or rotational alignment, between the male end 205 and the female end 105.

In some embodiments, therefore, the angular displacement between connecting trunk sections 100 and 200 is not problematic during assembly because the trunk sections 100 and 200 can be joined at any number of angular displacements. Thus, a person assembling a Christmas tree utilizing an embodiment of the present disclosure can more readily assemble the various trunk sections (e.g., 100 and 200) without having to rotationally align male end 205 with female end 105.

In addition, because some embodiments of the present disclosure allow rotation while assembled, the assembler of the Christmas tree can rotate the various trunk sections to some degree after assembly to achieve a desired appearance. But, in some embodiments, as shown in FIGS. 1 and 2, the male end 205 and the female end 105 can comprise one or more alignment mechanisms 125, 225. The alignment mechanisms 125, 225 can comprise ridges and grooves, or similar structures such as detents, bumps, or teeth. In some embodiments, the ridges and grooves of the alignment mechanism 125 of the female end 105 and the ridges and grooves of the alignment mechanism 225 of the male end 205 can engage when the female end 105 and the male end 205 join together. This engagement can prevent the trunk sections 100 and 200 from rotating with respect to one another. Preventing rotation can be advantageous to a user who desires to prevent portions of a tree from rotating after assembly, such as when the user decorates the tree with lights and other accessories.

In some embodiments, central male prong 210 and/or channel male prong 215 can be spring loaded. For example, when male end 205 is physically disconnected from female end 105, central male prong 210 and/or channel male prong 215 can be recessed or retracted. Likewise, when male end 205 is physically connected to female end 105, central male prong 210 and/or channel male prong 215 can be extended, by spring action, to provide for electrical connectivity. Employing spring loaded prongs 210, 215 can help to reduce wear and tear on the prongs 210, 215 and can also help to reduce the likelihood of electrical shock when central male prong 210 and/or channel male prong 215 are energized.

Embodiments of the present disclosure can comprise a central receiving void 110 and/or a channel receiving void 115 with spring loaded safety covers. More specifically, the central receiving void 110 and/or a channel receiving void 115 can have one or more covers that obstruct access to the voids when they are not engaged with prongs of a male end 205. In this manner, the safety covers can prevent a user from unintentionally inserting a finger or other object into the voids and receiving an electric shock. The covers can be spring loaded so that they can be depressed by the prongs of the male end 205 as the male end 205 and the female end 105 are joined.

In some embodiments, it can be desirable to have a guide system, such as a sleeve system, that assists the assembler in aligning the various tree trunk sections with each other during assembly. In some embodiments, a sleeve system can also help secure the tree trunk sections to each other when assembled, and can prevent the assembled tree from swaying or wobbling.

FIG. 1 shows outer sleeve 120 and FIG. 2 shows inner sleeve 220 of a sleeve system. As shown in FIGS. 1 and 2, the outer sleeve 120 is disposed proximate the female end 105 and the inner sleeve 220 is disposed proximate the male end 205. But, in some embodiments, the outer sleeve 120 may be disposed proximate the male end 205 and the inner sleeve 220 may be disposed proximate the female end 105.

When an assembler is joining female end 105 to male end 205, and thus joining their respective tree trunk sections 100 and 200, outer sleeve 120 and inner sleeve 220 can engage and act as guides to help bring the two tree trunk sections 100 and 200 together. Moreover, the use of a sleeve system, such as outer sleeve 120 and inner sleeve 220, can provide additional benefits. For example, the inner diameter of outer sleeve 120 can be the same size, or nearly the same size, as the outer diameter of inner sleeve 220 to provide for a secure fit between female end 105 and male end 205. This can help provide lateral support to the joined tree trunk sections 100 and 200, thus reducing the likelihood that a force applied to one of the tree trunk sections (i.e., 100 and/or 200) will cause the tree trunk sections 100 and 200 to wobble or separate. An exemplary sleeve system can be found in U.S. Pat. No. 8,916,242, entitled, "Connector System," which is owned by the Applicant and the contents of which are hereby incorporated by reference.

Figure 3A:
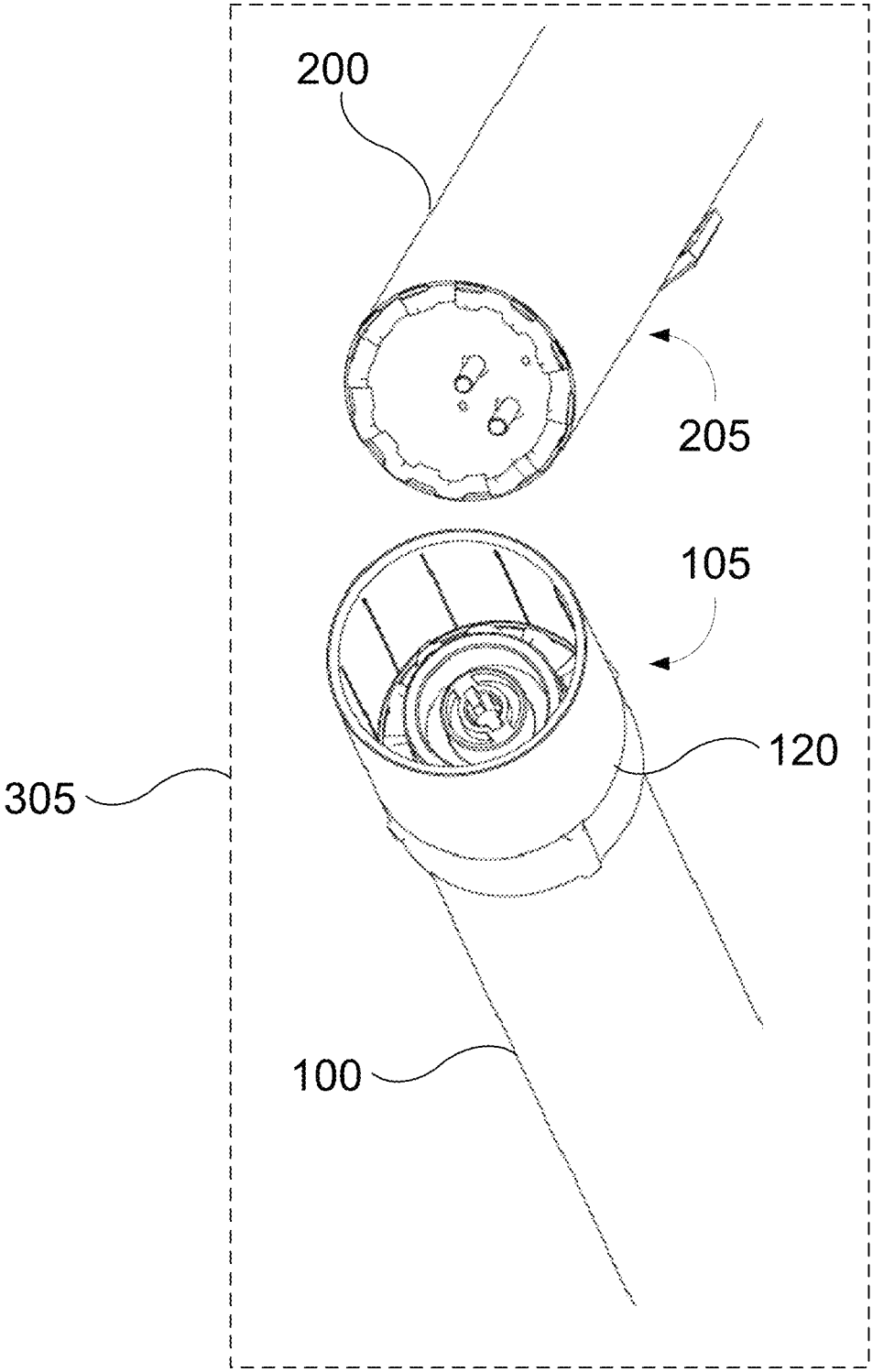
FIG. 3A depicts a perspective view of a female end of a tree trunk section in proximity to a male end of a tree trunk section, in accordance with some embodiments of the present disclosure.
Figure 3B:
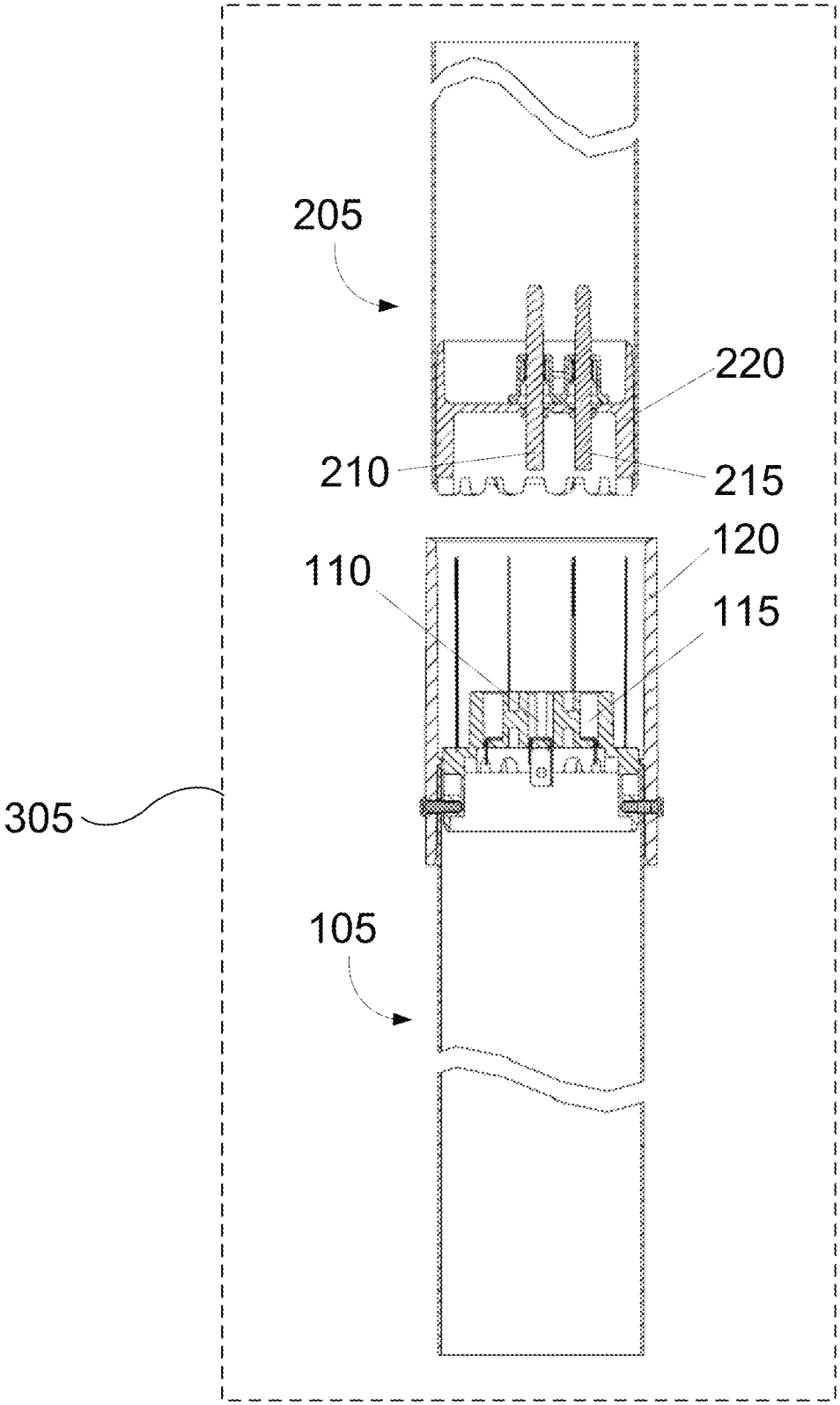
FIGS. 3B and 3C depict cross-sectional views of a female end of a tree trunk section being joined with a male end of a tree trunk section, in accordance with some embodiments of the present disclosure.
Figure 3C:
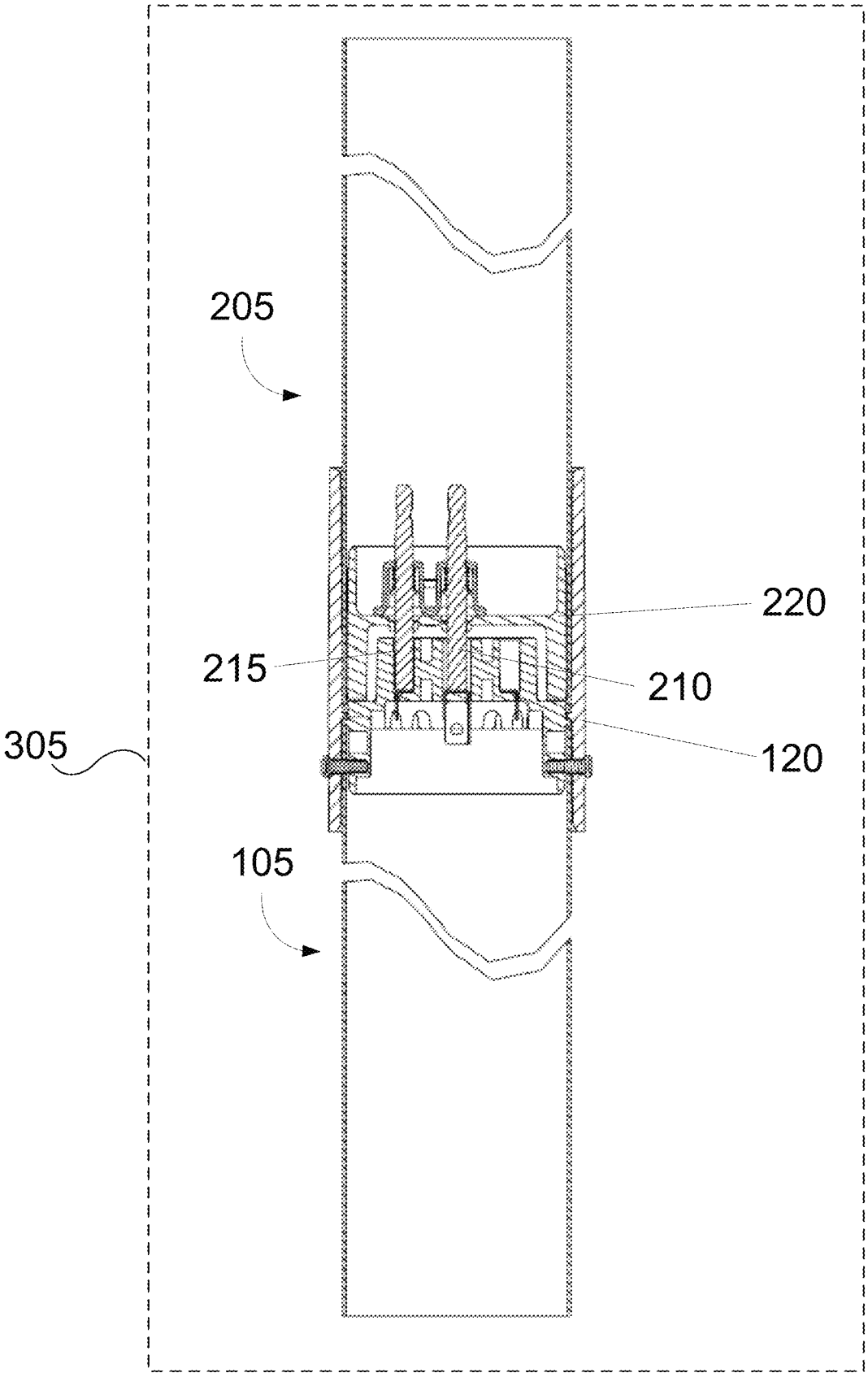

FIGS. 3A-C show a process of connecting a male end 205 with a female end 105 to form a power distribution system 305. Referring to FIG. 3A, illustrated are male end 205 of a first tree trunk section 100 and female end 105 of a second tree trunk section 200 in a disconnected configuration. When assembling a tree, according to various embodiments of the present disclosure, a user can connect trunk sections 100 and 200 by connecting male end 205 with female end 105. More specifically, the user can vertically align the trunk sections 100 and 200, as shown in FIG. 3B, which is a cross-sectional view. Once vertically aligned, or at least sufficiently aligned to permit joining, the assembler can move one trunk section 100 closer to the other trunk section 200 until the trunk sections 100 and 200 engage and are joined, as shown in FIG. 3C. In doing so, the assembler has also joined male end 205 with female end 105, providing electrical connectivity between the two pictured trunk sections 100 and 200. More particularly, the central male prong 210 is inserted into central receiving void 110 and channel male prong 215 is inserted into channel receiving void 115, allowing electricity to flow between the male end 205 and the female end 105, thus completing power distribution system 305.

Figure 4:
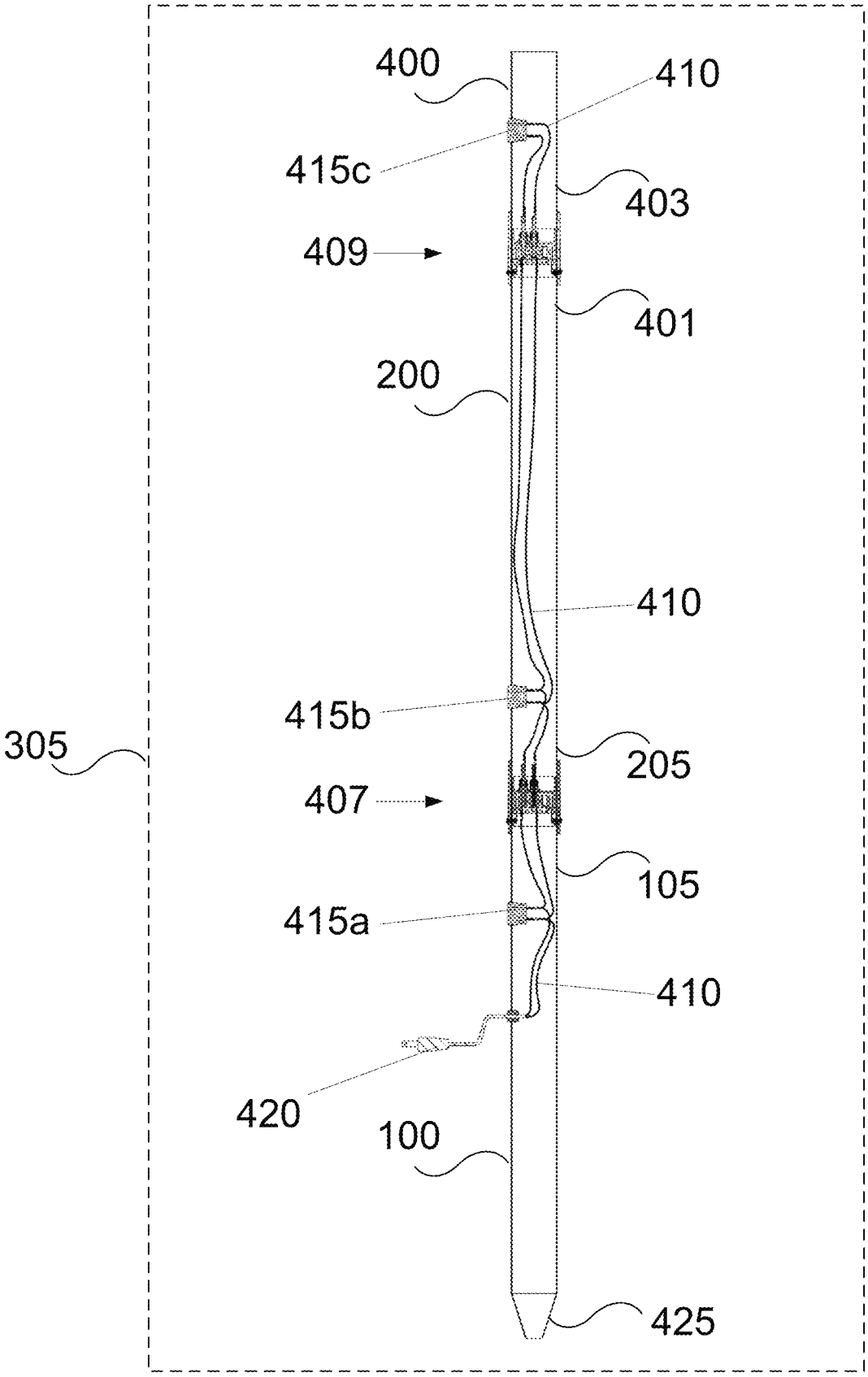
FIG. 4 depicts a cross-sectional view showing a power distribution system of an assembled tree trunk, in accordance with some embodiments of the present disclosure.

FIG. 4 shows a cross-section of an exemplary embodiment of the present disclosure. Shown are three trunk sections 100, 200, and 400, and two connection areas 407 and 409. Connection area 407 is where the female end 105 of trunk section 100 and the male end 205 of trunk section 200 join. Connection area 409 is where the female end 401 of trunk section 200 and the male end 403 of trunk section 400 join. Accordingly, the connection areas 407 and 409 are areas where trunk sections 100, 200, and 400 are connected to form power distribution system 305.

As shown in FIG. 4, a power distribution system 305 can comprise a first female end 105 connected to a first male end 205, a second female end 401 connected to a second male end 403, and one or more electrical wires 410. The wires 410 enable electricity to flow through the trunk sections 100, 200, and 400, and between the first male and female ends 205, 105 and the second male and female ends 403, 401 of power distribution system 305. Thus, the wires 410, as part of the power distribution system 305, enable power to flow from a power source, such as a wall outlet, through the tree and to certain accessories, such as a one more lights or strands of lights. The lights or strands of lights can therefore be illuminated when power is supplied to the tree.

In some embodiments, it can be desirable to provide for one or more electrical outlets 415 on the trunk sections 100 and 200 along the length of the assembled tree. Thus, one or more power distribution systems 305 can comprise one or more electrical outlets (e.g., 415*a*, 415*b*). Outlets 415*a*, 415*b*, and 415*c* can be configured to receive power from wires 410 to provide a user with the ability to plug in devices, such as tree lights or other electrical components. By providing a convenient location to plug in lights, outlets (e.g., 415*a-c*) can minimize the amount of effort required to decorate a tree. More specifically, a user can plug a strand of lights directly into an outlet (e.g., 415*a*) on a trunk section 100, instead of having to connect a series of strands together, which can be cumbersome and frustrating for a user.

Embodiments of the present disclosure can further comprise strands of lights that are unitarily integrated with the power transfer system. Thus, the lights can be connected to the wires 410 without the need for outlets (e.g., 415*a-c*), although outlets 415*a-c* can be optionally included. Such embodiments can be desirable for trees that come pre-strung with lights, for example.

In some embodiments, one or more trunk sections (e.g., 100, 200, 400) can comprise a power cord 420 for receiving power from an outside power source, such as a wall outlet or a battery. The power cord 420 can be configured to engage a power source and distribute power to the rest of the tree. More specifically, power can flow from the wall outlet, through the power cord, through the power distribution system 305, and to accessories on the tree, such as lights or strands of lights. In some embodiments, the power cord 420 can be located on a lower trunk section 100 of the tree for reasons of convenience and appearance (i.e., the power cord 420 is close to the wall outlets and exits the tree at a location that is not immediately visible).

Embodiments of the present disclosure can also comprise a bottom section 425 of one or more trunk sections 100. The bottom section 425 can be substantially conical in shape, and can be configured to engage a stand for the tree (not shown). Accordingly, the bottom section 425 can be inserted into the stand, and the stand can support the tree, usually in a substantially vertical position.

In some embodiments, as shown in FIG. 4, it can be advantageous for a lowest trunk section 100 of a tree to comprise a female end 105. During assembly, a male end 205 of a neighboring trunk section 200 can be joined with the female end 105 of the lowest trunk section 100. This can improve safety during assembly because the exposed male prongs are not energized, i.e., they do not have electricity flowing through them until they are inserted into the female end 105. To the contrary, if the lowest trunk section comprises a male end (e.g., 205), energized prongs can be exposed, and accidental electrical shock can result. Ideally, the power cord 420 is not plugged into a wall outlet until the tree is fully assembled, but embodiments of the present disclosure are designed to minimize the risk of injury if the tree is plugged in prematurely.

Figure 5:
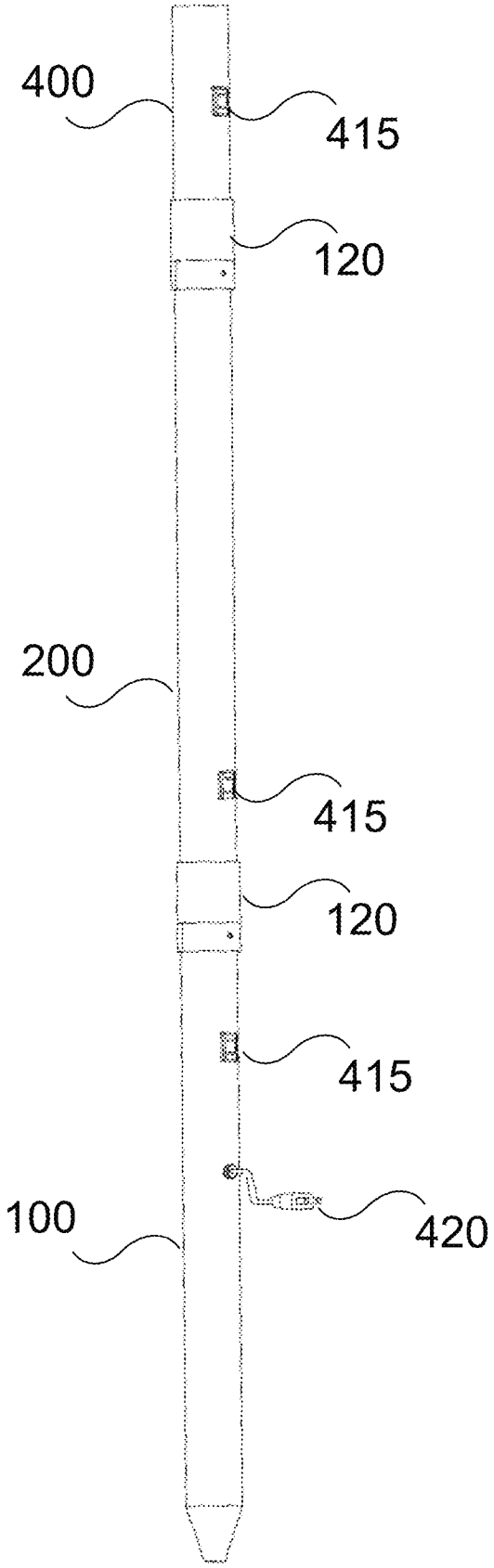
FIG. 5 depicts a side view of an assembled tree trunk, in accordance with some embodiments of the present disclosure.

FIG. 5 is an external, side view of an assembled tree trunk according to various embodiments of the present disclosure. Three tree trunk sections 100, 200, and 400 are assembled and physically connected to one another to support the tree. As discussed previously, it can be desirable to use a sleeve system to secure one tree trunk section 100 to another tree trunk section 200, and outer sleeves 120 of the sleeve system are also shown in FIG. 5. Power outlets 415 and power cord 420 are also shown.

Other embodiments of the present disclosure can comprise additional features, different features, and/or different combinations of features than the embodiments described above. Some of these embodiments are described below.

Figure 6:
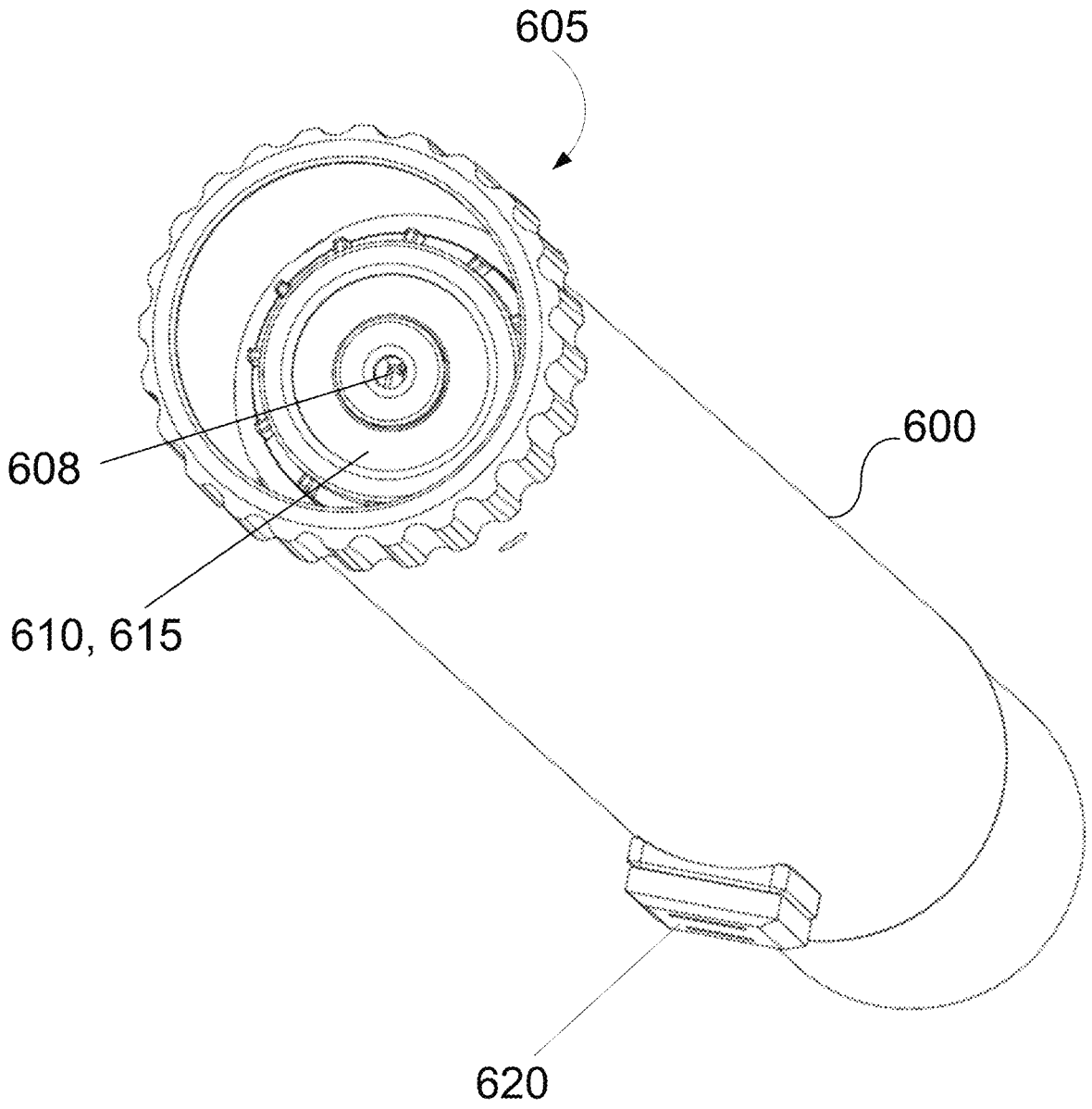
FIG. 6 depicts a perspective view of a female end of a tree trunk section, in accordance with some embodiments of the present disclosure.

FIG. 6 shows an exemplary embodiment of a female end 605 of a tree trunk section 600, which may be used in a power distribution system. Like previously described embodiments, female end 605 can have a one or more of power voids for receiving power from, or distributing power to, a male end of a tree trunk section (e.g., 200). In the embodiment shown in FIG. 6, female end 605 can comprise central receiving void 608 for engaging with a prong of a male end and channel receiving void 610 for engaging with another prong of a male end. In some embodiments, the channel receiving void 610 can be protected by a safety cover 615 when it is not engaged with a prong of a male end. Outlet 620, as described above, is also shown.

Figure 7:
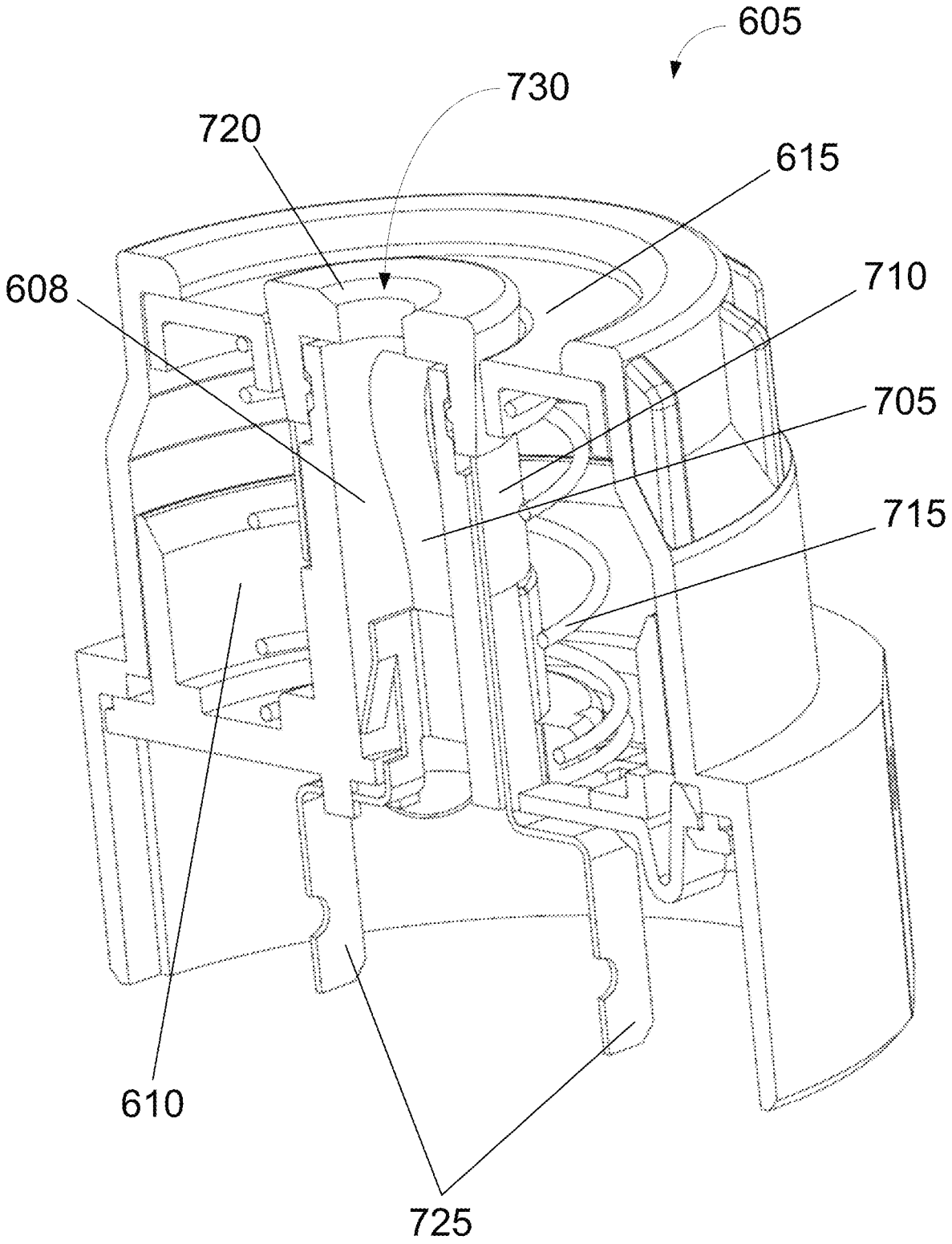
FIG. 7 depicts a perspective, cross-sectional view of a female end of a tree trunk section, in accordance with some embodiments of the present disclosure.

FIG. 7 shows a cross-section of female end 605 adapted for use in a power distribution system. The interior of the central receiving void 608 and channel receiving void 610 are shown. Also shown is central contact device 705 and channel contact device 710.

Central contact device 705 can be at least partially disposed within central receiving void 608 and can be designed to make electrical contact with a prong inserted into central receiving void 608. Similarly, channel contact device 710 can be at least partially disposed within channel receiving void 610, and can be designed to make electrical contact with a prong inserted into channel receiving void 610. In this manner, central contact device 705 and channel contact device 710 can conduct power from a male end to a female end 605, or from a female end 605 to a male end, which combine to form a power distribution system.

Safety cover 615 and spring member 715 are also shown in FIG. 7. Safety cover 615 can provide a covering for channel receiving void 610 when the female end 605 is not engaged with a male end. The safety cover 615 can therefore prevent a person from inadvertently touching channel contact device 810, which could lead to electric shock. The safety cover 615 can also prevent various items from entering channel receiving void 610 and causing damage to or blocking access to the channel contact device 710. Safety cover 615 can be supported by spring member 715, which can apply a force to the safety cover 615 to obstruct access to the channel receiving void 610 when not in use. When a male end is joined with the female end 605, the pushing surface 1020 of the male end cylinder 915 can push against the safety cover 615. This can cause the spring member 715 to flex and become depressed, depressing the safety cover 615, and thereby enabling access to channel receiving void 610 and channel contact device 710.

Female end 605 can further comprise a safety gate 720 at the opening of the central receiving void 608. The safety gate 720 can comprise an opening 730 that can be the same dimensions as, or nearly the same dimensions as, a prong of a male end that is inserted through the safety gate 720. In some embodiments, therefore, the opening 730 of the safety gate 720 can be too small to accommodate a finger, and can therefore prevent a user from inserting his or her finger into receiving void 608 and receiving an electric shock. The opening 730 can also be small enough to prevent insertion of many other foreign objects, such as metal kitchen utensils, for example.

Figure 8:
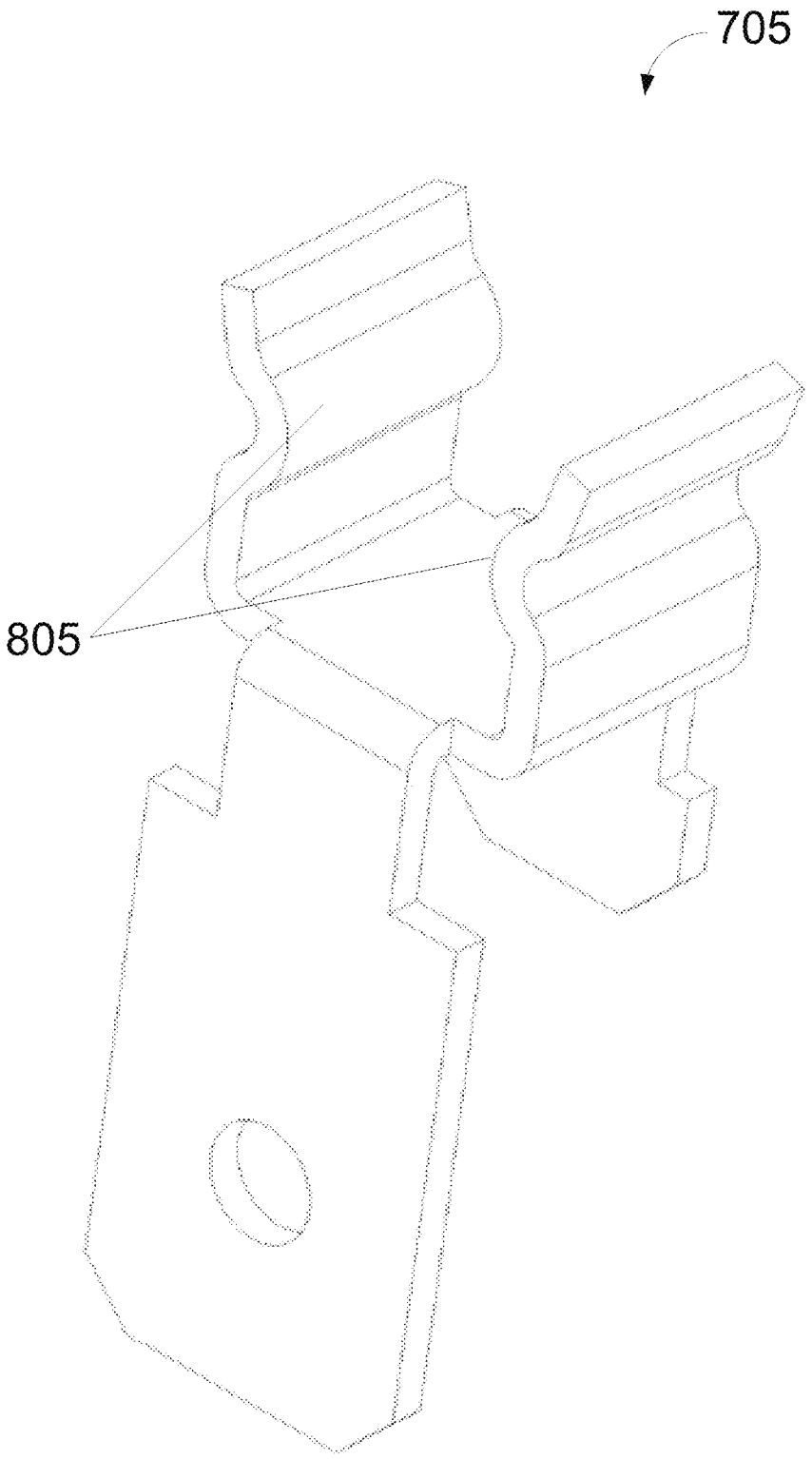
FIG. 8 depicts a central contact device with contact sections, in accordance with some embodiments of the present disclosure.

As shown in FIG. 8, in some embodiments, central contact device 705 can have one or more contact sections 805 that utilize spring action to make contact with a prong inserted into central receiving void 608. More specifically, the contact sections 805 can be configured such that they contact a prong as the prong is inserted into the central receiving void 608. As the prong is further inserted into the void, the prong can abut the contact sections 805, pushing the contact sections 805 outwardly, and causing the contact sections 805 to press against (i.e., spring back against) the prong. In this manner, the spring action of the contact sections 805 can ensure that the electrical connection between the contact sections 805 and the prong is effective to transfer electrical power. In addition, the contact sections 805 can be sufficiently large to ensure an effective electrical connection.

Figure 9:
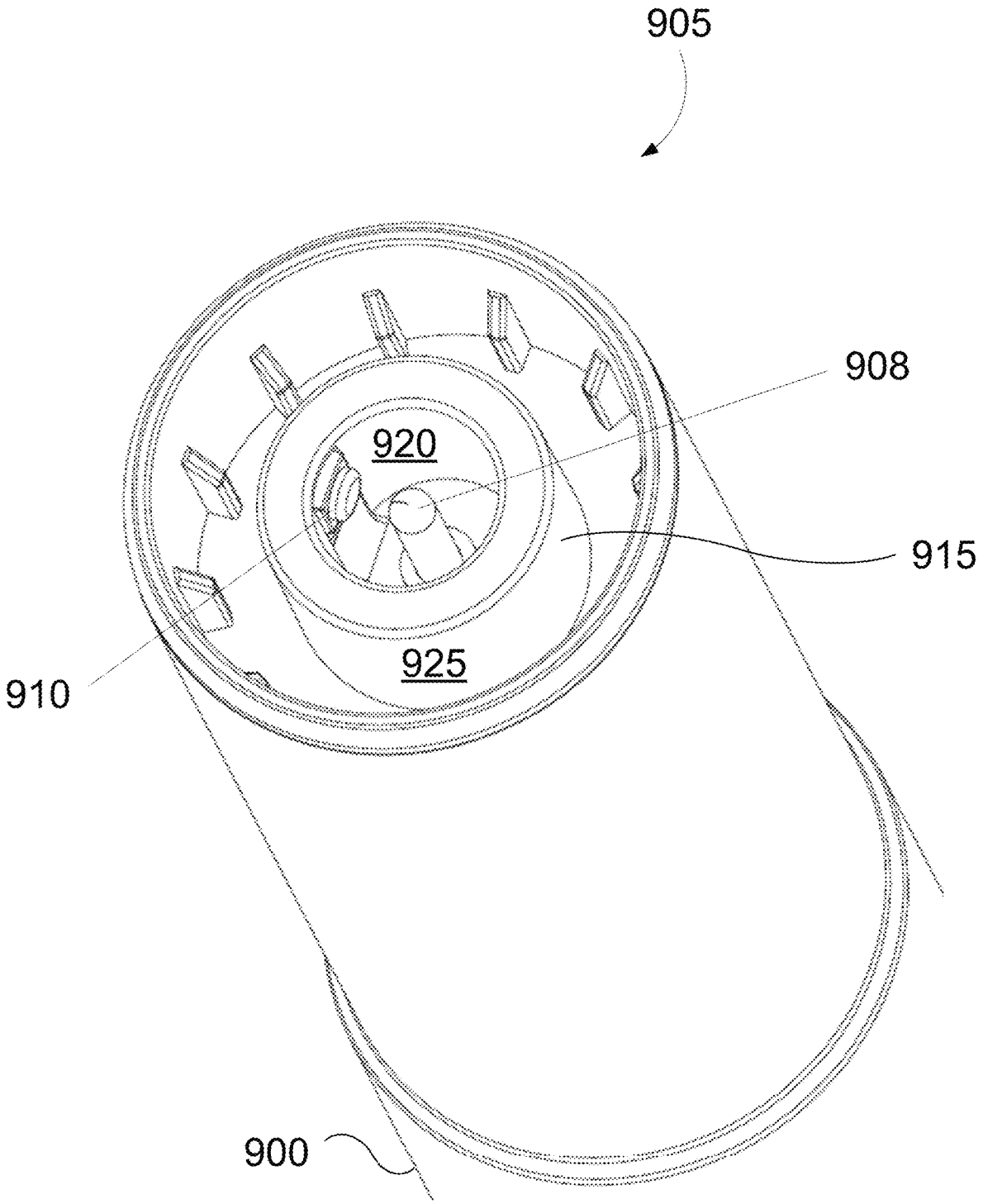
FIG. 9 depicts a perspective view of a male end of a tree trunk section, in accordance with some embodiments of the present disclosure.

FIG. 9 depicts an exemplary embodiment of a male end 905 of a tree trunk section 900, which may be used in a power distribution system. Similar to previously described embodiments, male end 905 can have one or more prongs for receiving power from, or distributing power to, a female end 605 of a tree trunk section 100. As shown in FIG. 9, male end 905 can have a central male prong 908 and a channel male prong 910. In some embodiments, when the central male prong 908 and channel male prong 910 of the male end 905 are inserted into the central receiving void 608 and channel receiving void 610 of the female end 605, respectively, electrical power can be conducted from male end 905 to female end 605, or vice versa, depending on the direction of electrical power flow. Further, as shown in FIG. 9, a male end 905 may comprise a male end cylinder 915 having an interior wall 920 and exterior wall 925. In one embodiment, the central male prong 908 may be disposed proximate the center of the cylinder, and the channel male prong 910 may be disposed proximate the interior wall 920 of the cylinder 915.

Figure 10:
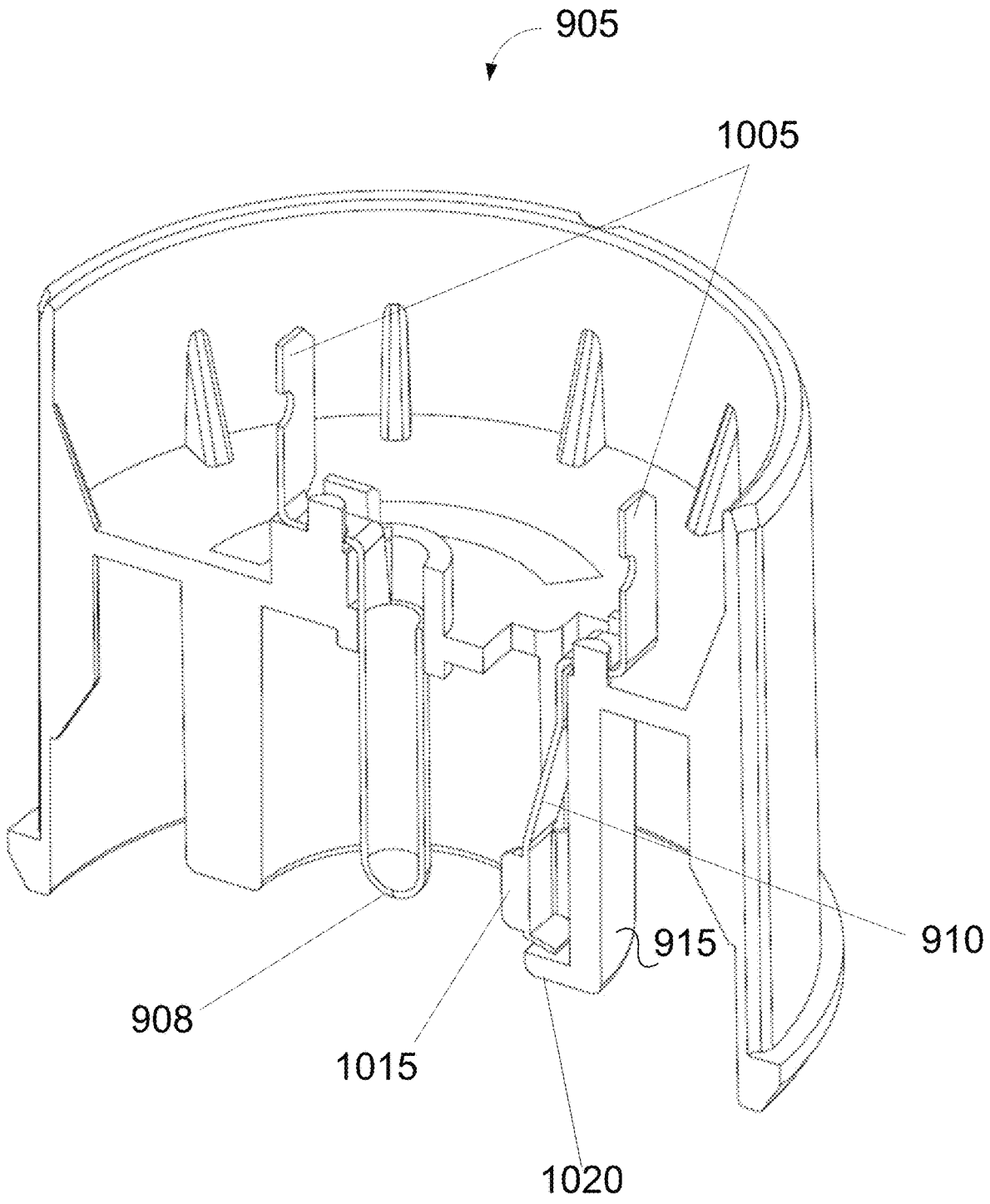
FIG. 10 depicts a perspective, cross-sectional view of a male end of a tree trunk section, in accordance with some embodiments of the present disclosure.

FIG. 10 shows a cross-section of male end 905 adapted for use in a power distribution system. The central male prong 908 and the channel male prong 910 are both shown. In some embodiments, as shown in FIG. 10, the central male prong 908 has a rounded end that enables the central male prong to engage and separate the contact sections 805 of the central contact device 705. In this manner, after being pushed apart, the contact sections 805 of the central contact device 705 can abut the central male prong 908, providing an effective electrical connection.

In some embodiments, channel male prong 910 can be a bendable prong that flexes as it makes contact with channel contact device 710. More specifically, channel male prong 910 can flex inwardly and outwardly, as required, as it slides into channel receiving void 610 and abuts channel contact device 710. The channel male prong 910 can be sufficiently resilient to flex, or spring toward channel contact device 710, thereby providing an effective electrical connection between the channel male prong 910 and the channel contact device 710.

In some embodiments, the channel male prong 910 can comprise a contact area 1015 that extends from the prong to engage the channel contact device 710, thereby facilitating contact between the channel male prong 910 and the channel contact device 710. Further, in some embodiments, the male end cylinder 915 can comprise a pushing surface 1020. The pushing surface 1020 can be configured to apply a force to the safety cover 615, thereby depressing the safety cover 615 as the male end 905 and the female end 705 are joined to form a power distribution system.

FIGS. 7 and 10 show that the male end 905 and the female end 605 of a power distribution system can comprise leads 725, 1005. The leads 725, 1005 can be electrically connected to one or more of the central male prong 908, channel male prong 910, central contact device 705, and channel contact device 710. In some embodiments, therefore, the leads 725, 1005 can electrically connect to wires of a power distribution system (e.g., power distribution system 305 as shown in FIG. 4) to provide electrical connectivity between a male end 905 and a female end 605.

Figure 11A:
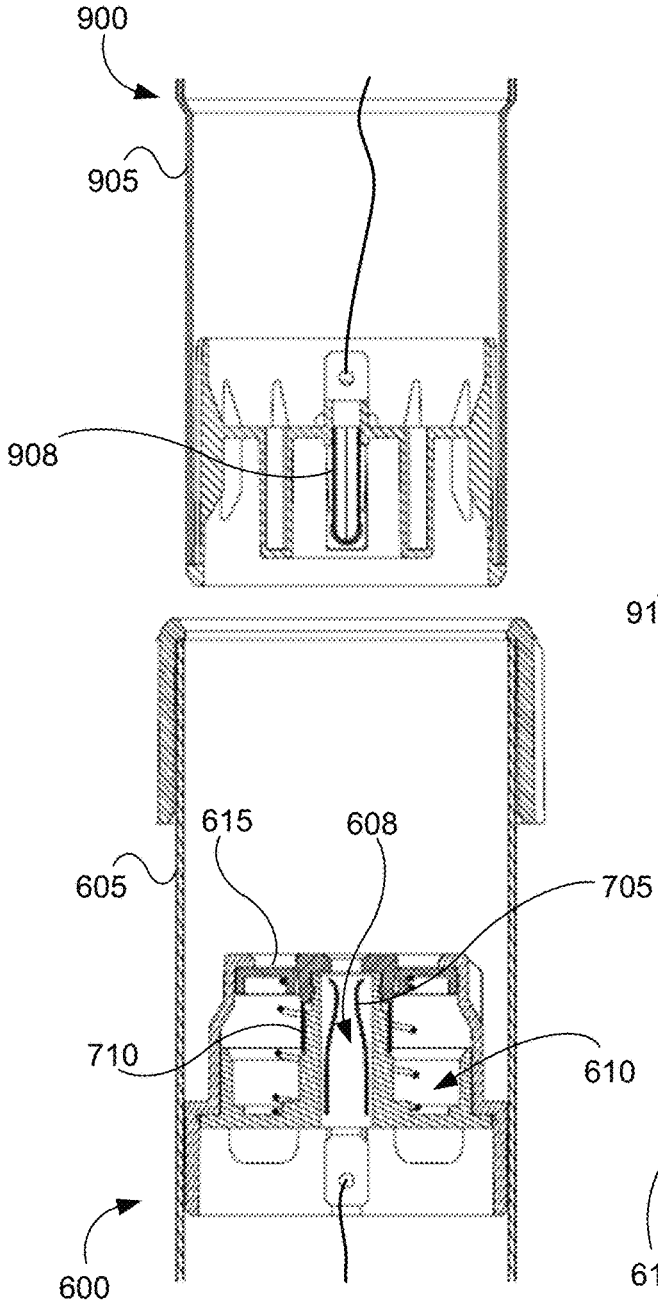
FIGS. 11A-D are cross-sectional views showing the connection of a male end with a female end, in accordance with some embodiments of the present disclosure.
Figure 11B:
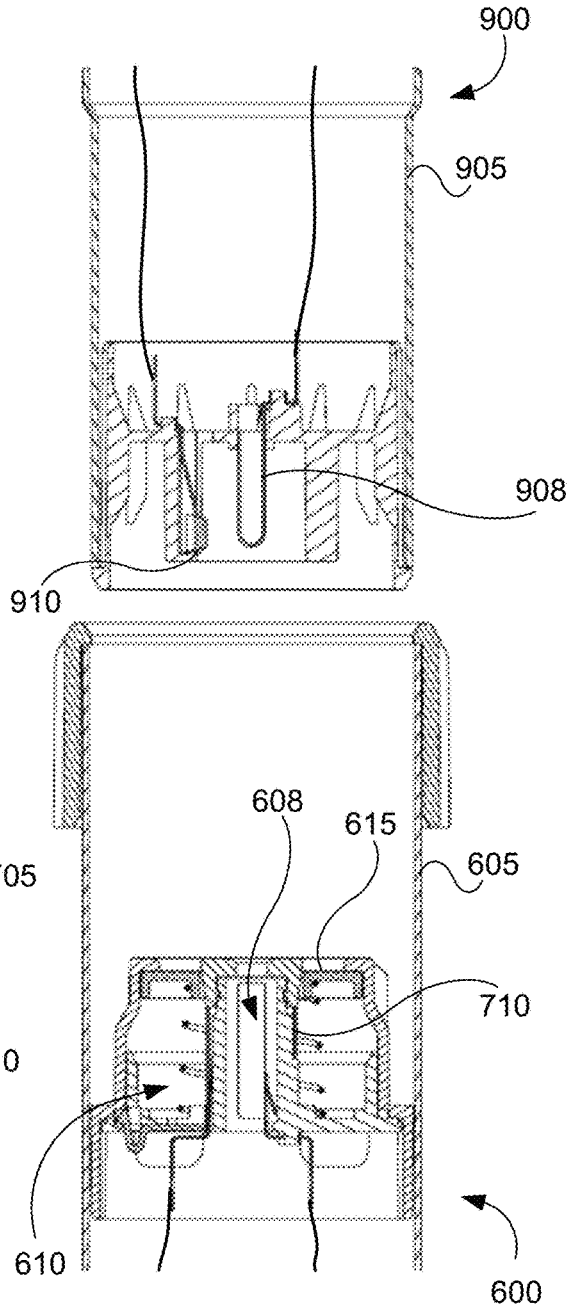
Figure 11D:
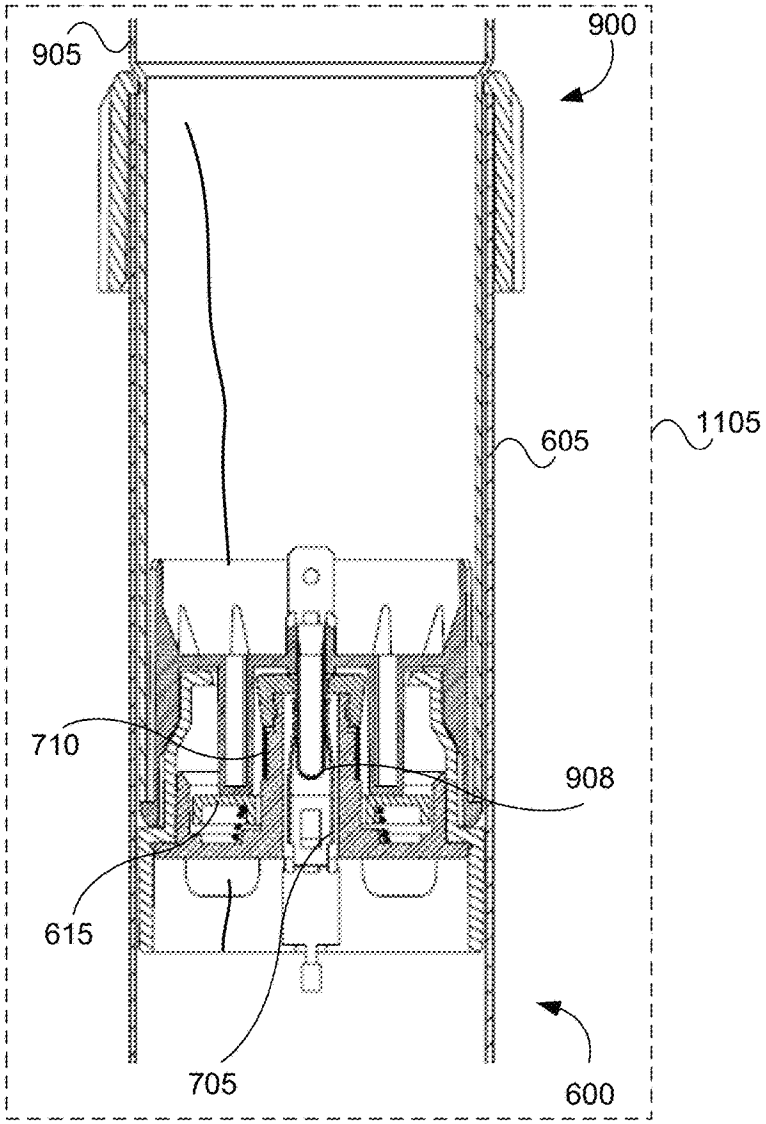
Figure 11C:
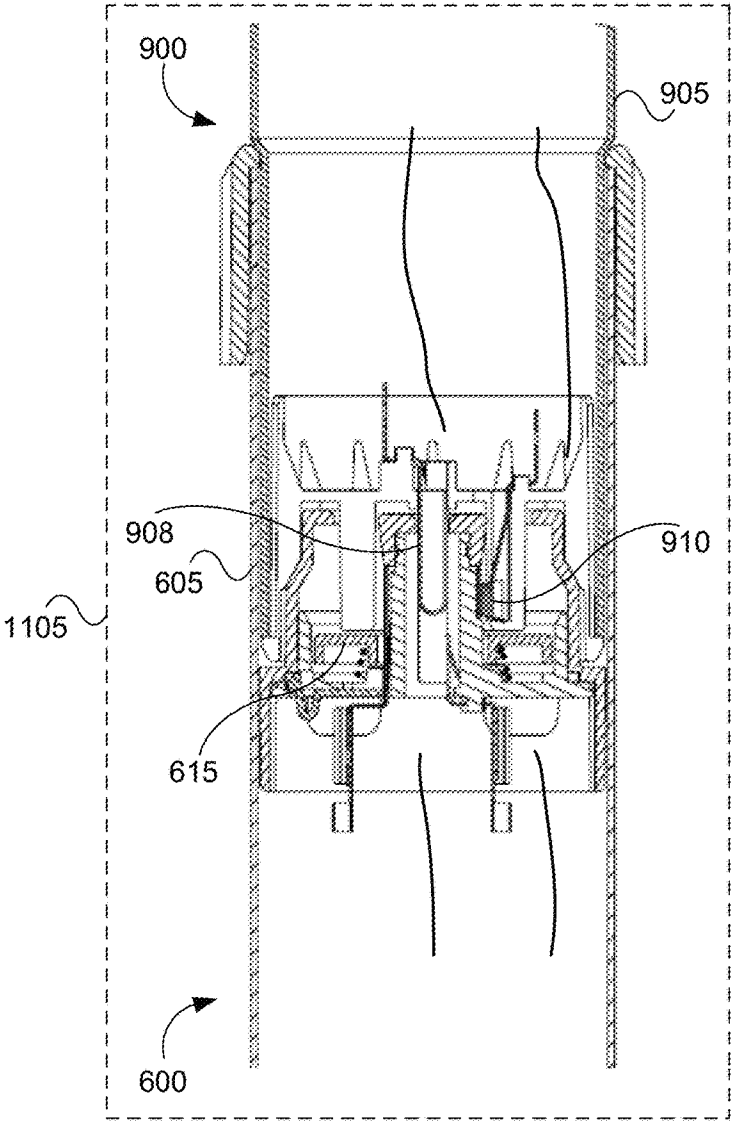

FIGS. 11A-D are cross-sections showing the connection of a male end 905 with a female end 605. Referring to FIGS. 11A and 11B, illustrated are male end 905 of a first tree trunk section 900 and female end 605 of a second tree trunk section 600 in a disconnected configuration. FIG. 11A shows a front cross-sectional view of this configuration, whereas FIG. 11B shows a side cross-sectional view. When assembling a tree, according to various embodiments of the present disclosure, the assembler can connect trunk sections 600 and 900 by connecting male end 905 with female end 605, thus forming a power distribution system. Initially, the assembler can vertically align the trunk sections 600 and 900, as shown in FIGS. 11A and 11B. Once vertically aligned, or at least sufficiently aligned to permit the adjoining, the assembler can move one trunk section (e.g., 900) closer to the other trunk section (e.g., 600) until the trunk sections 600 and 900 engage, as shown in FIGS. 11C-D. FIG. 11C shows a side cross-sectional view of this configuration, whereas FIG. 11D shows a front cross-sectional view. By connecting the male end 905 and the female end 605 as described above, the assembler provides electrical connectivity between in the power distribution system 1105 formed by joining male end 905 and female end 605.

As described above, in some embodiments, channel receiving void 610 is disposed in a circular manner around central receiving void 608, alleviating any issues concerning the angular rotation of male end 905 and female end 605 during assembly. More specifically, channel male prong 910 can be inserted at any number of positions or locations along channel receiving void 610, and establish and maintain electrical connectivity between female end 605 and male end 905.

To provide effective electrical connectivity, in some embodiments, the center male prong 908, the channel male prong 910, the central contact device 705, and the channel contact device 710 can comprise electrically conductive material. In some embodiments, for example, the center male prong 908, the channel male prong 910, the central contact device 705, and the channel contact device 710 can comprise one or more of copper, copper alloy, or any other conductive material.

As shown in FIGS. 11C and 11D, when male end 905 and female end 605 are joined, the safety cover 615 is depressed into an open position. This allows the channel male prong 910 to enter the channel receiving void 610, now occupied by channel male prong 910 and the safety cover 615, and electrically contact the channel contact device 710. In addition, central male prong 908 can contact the contact sections 805 of the central contact device 705, thereby completing the electrical connection between the male end 905 and female end 605 of the power distribution system 1105.

Figure 12:
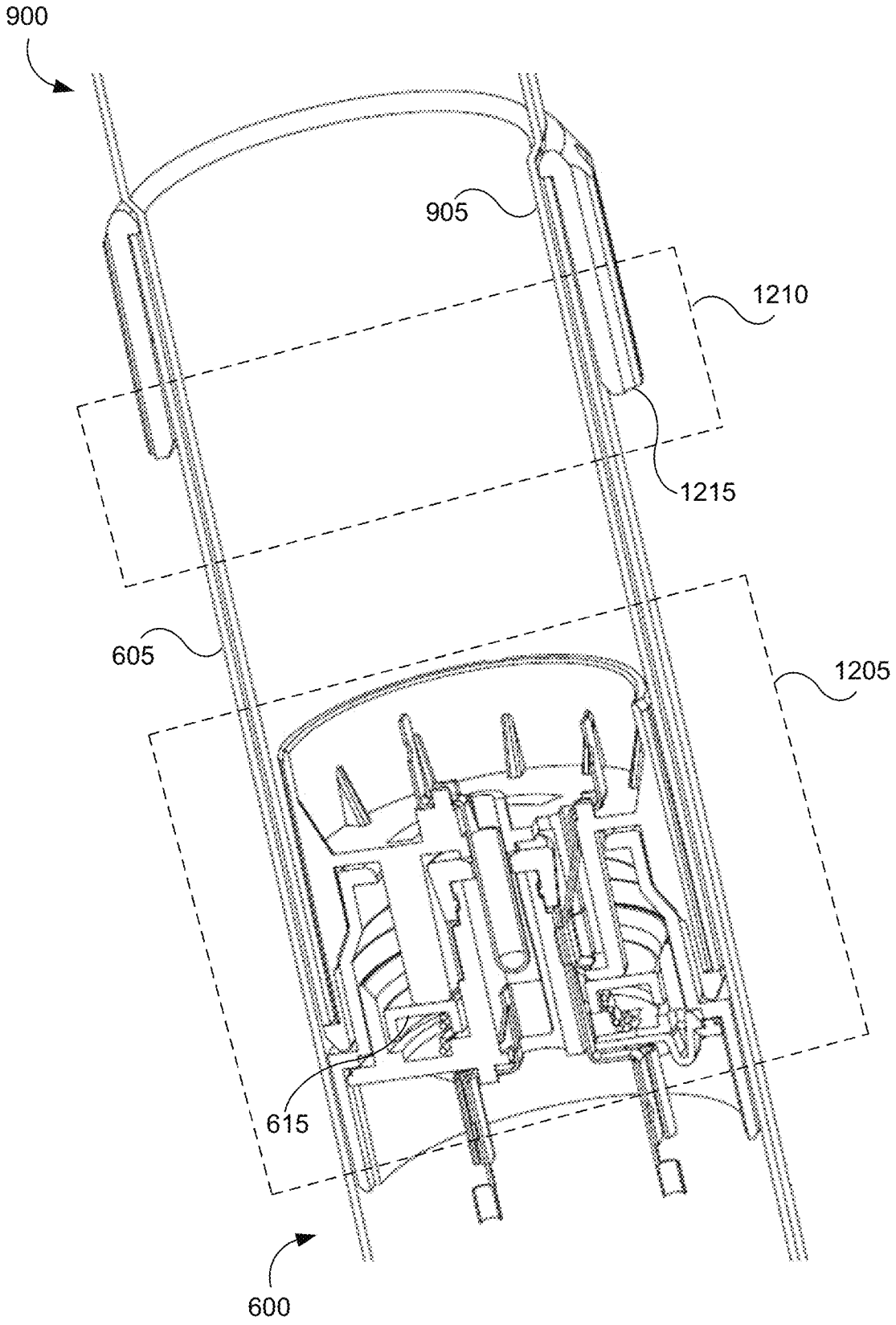
FIG. 12 depicts a perspective, cross-sectional view of a female end of a tree trunk section joined with a male end of a tree trunk section, in accordance with some embodiments of the present disclosure.

FIG. 12 shows a perspective, cross-sectional view of two joined trunk sections 600 and 900. In some embodiments, joined trunk sections 600 and 900 can comprise one or more pivot areas. A first pivot area 1205 can be disposed proximate the area where the male end 905 and the female end 605 join. A second pivot area 1210 can be at a location proximate an area where the outer sleeve 1215 terminates. Thus, the inclusion of two pivot areas can prevent rocking of the trunk sections 600 and 900 when they are joined. This can be advantageous as it can enable the assembled tree maintain balance, thereby preventing the tree from unintentionally falling over.

Figure 13A:
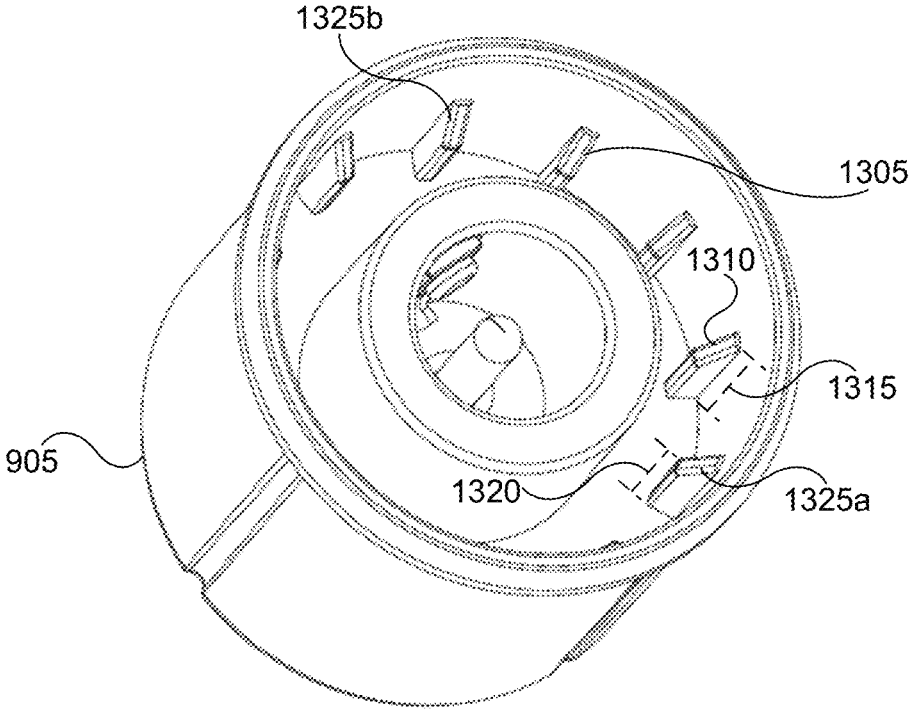
FIG. 13A depicts a perspective view of a male end of a tree trunk section with clutch elements, in accordance with some embodiments of the present disclosure.

FIG. 13A shows an exemplary embodiment of a male end 905 of a a tree trunk section 900. In some embodiments, the male end 905 can comprise one or more first clutch elements 1305. In some embodiments, the first clutch elements 1305 can be protrusions that extend inwardly or outwardly proximate the sides of the male end 905. In other embodiments, the first clutch elements 1305 can be detents, grooves, tabs, slots, and the like. As shown in FIG. 13A, in some embodiments, the first clutch elements 1305 have a top surface 1310. For example, in one embodiment, the top surface 1310 may angle down from a first height 1315 (represented by dashed lines) to a second height 1320 (similarly represented by dashed lines). In one embodiment, a top surface 1320 that angles from a first height 1315 to a second height 1320 may allow the first clutch element 1305 to disengage from a clutch element of a female end (e.g., female end 605). Further, while the top surface 1320 may be a flat surface, the top surface 1320 may comprise two or more facades, which may be angled away from one another (e.g., similar to the roof of a house), adapted to assist the first clutch element 1305 from disengaging a clutch element of a female end (e.g., female end 605) when the first clutch element 1305 comes into contact with a clutch element of a female end.

Figure 13B:
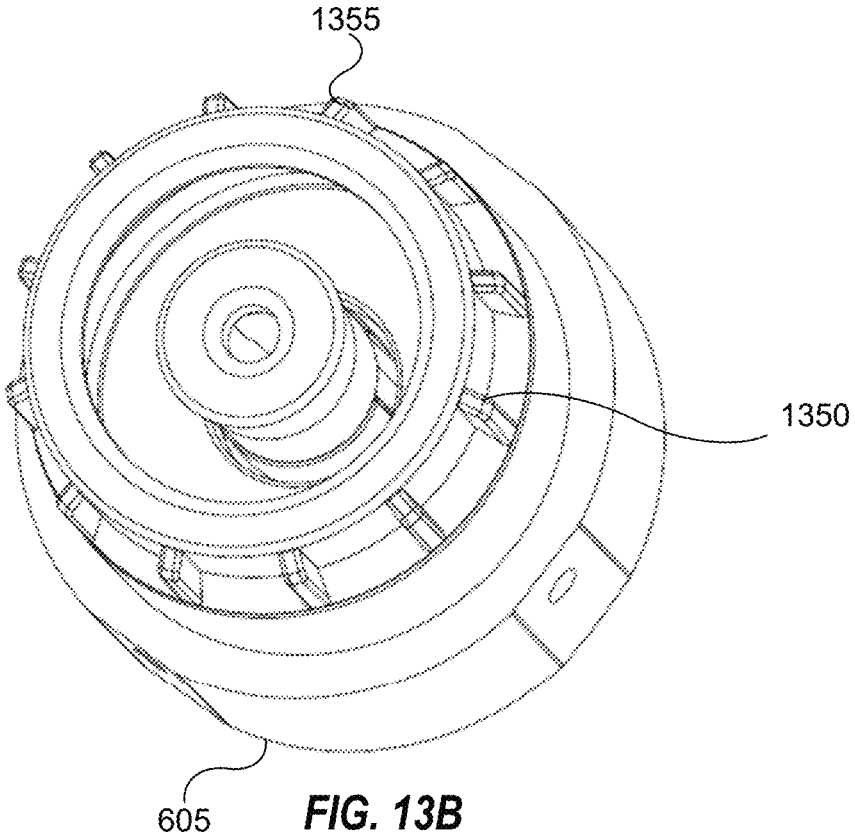
FIG. 13B depicts a perspective view of a female end of a tree trunk section with clutch elements, in accordance with some embodiments of the present disclosure.

FIG. 13B shows an exemplary embodiment of a female end 605 of a tree trunk section 600. As shown, the female end 605 can comprise one or more second clutch elements 1350. In some embodiments, the second clutch elements 1350 can be protrusions that extend inwardly or outwardly proximate the sides of the female end 605. In other embodiments, the second clutch elements 1350 can be detents, grooves, tabs, slots, and the like. As shown in FIG. 13B, the second clutch elements 1350 may comprise a top surface 1355. As with the first clutch element 1305, the top surface 1355 may angle from a first height to a second height. Further, the top surface 1355 may be flat or comprise a plurality of facades to assist is disengaging the second clutch element 1350 from a first clutch element 1305 when a female end 605 comes into contact with a male end 905 when, for example, an assembler puts together a Christmas tree of the present disclosure.

As noted above, when two trunk sections (e.g., 600 and 900) are joined such that they are in electrical communication, the first clutch elements 1305 of the male end 905 and the second clutch elements 1355 of the female end 605 can engage. The engaging clutch elements can prevent the two trunk sections 600, 900 from rotating with respect to one another after tree assembly is complete. This can be advantageous as it can allow a user to align and maintain the trunk sections 600, 900, and thus the branches of the tree, in a desired configuration. Accordingly, the trunk sections 600, 900 and branches cannot later rotate out of configuration when the tree is decorated or otherwise touched, pulled, bumped, etc.

Moreover, it would be advantageous for the type of rotational trees discussed herein to be adapted for use with, for example, various LED lights that allow for thousands of color combinations. In some embodiments, a string of LED lights may comprise a plurality of LED lamps. These LED lamps may be referred to as "RGB LED lamps" and may comprise three LED chips (i.e., red, green, and blue) in addition to an embedded microcontroller unit (MCU). In some embodiments, the embedded MCU comprises at least four leads: two for voltage connections, an electronic signal input, and an electronic signal output. In some embodiments, a separate MCU (i.e., an MCU that is not embedded in an LED lamp and may be mounted proximate to the base of a Christmas tree) transmits a signal that is received by the embedded MCU at the electronic signal input. The embedded MCU processes the signal and outputs signals to each of the red, green, and blue LED chips, as necessary, to enable the LED to produce the desired color.

In some embodiments, the string of RGB LED lights can be connected in series. Thus, the embedded MCU can transmit the received signal, via the signal output, to the next embedded MCU, which receives the signal via its signal input line, and so on down the series of lights. Accordingly, in some embodiments, the male and female components of a power distribution system comprise at least four electrical connections for compatibility with such LED lamps. FIGS. 14-17 illustrate components of a power distribution system comprising four electrical connections.

Figure 14:
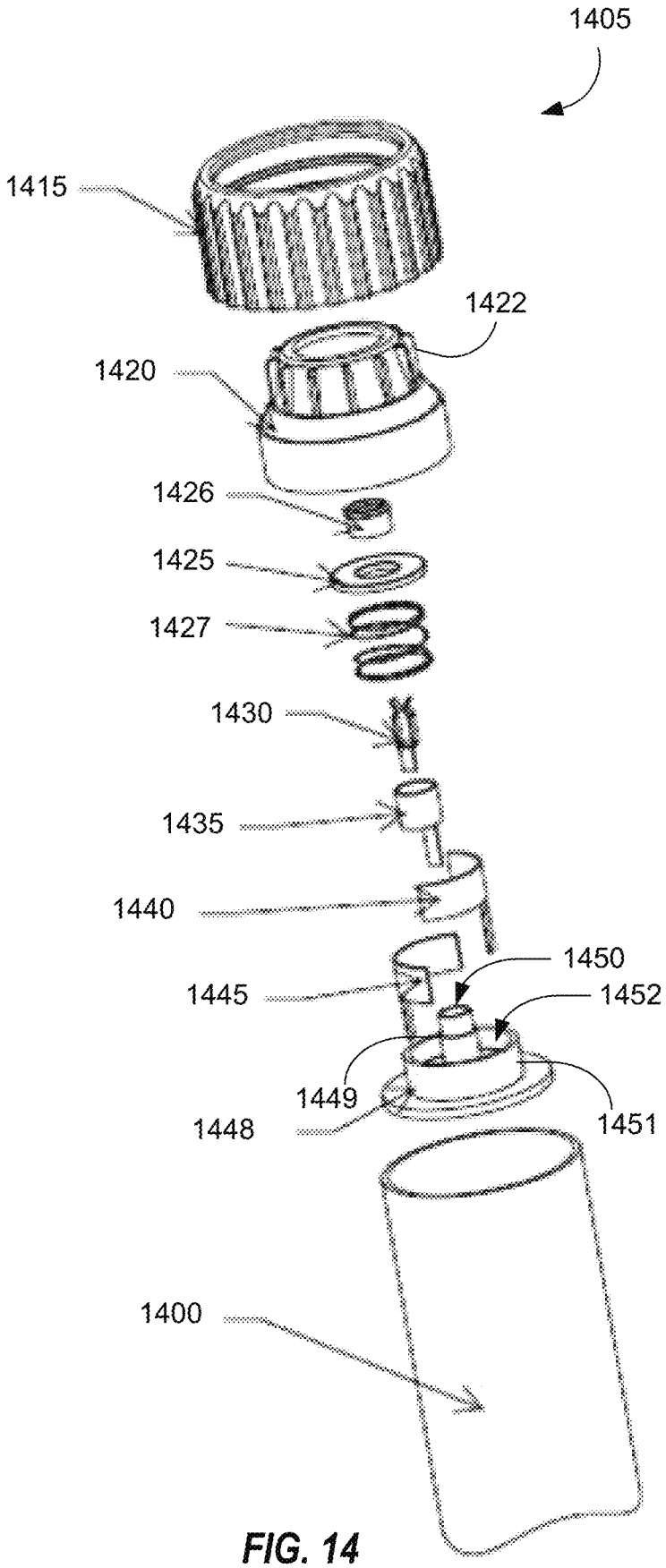
FIG. 14 depicts an exploded view of a female end of a tree trunk section with clutch elements and four electrical connections, in accordance with some embodiments of the present disclosure.

FIG. 14 is an exploded view of a female end 1405 of a tree trunk section 1400, according to one embodiment. As shown, the female end may comprise an outer collar (or outer sleeve) 1415 for coupling the tree trunk section 1400 to a second trunk section (e.g., 900) to form a power distribution system. Further, the female end 1405 may comprise a female end cover 1420, which may comprise a plurality of clutch elements 1422 with functionality the same as or similar to first and second clutch elements 1305, 1350.

The female end 1405 may further comprise a female end base 1448 that comprises a central receiving void (or central void) 1450 and channel receiving void (or channel void) 1452, which may be configured similarly to central receiving void 608 and channel receiving void 610 as discussed above. Further, in some embodiments, a female end base 1448 may comprise a female end base extension 1449 and an outer wall 1451. In some embodiments, the central receiving void 1450 may be disposed within the female end base extension 1449. Further, the female end base extension 1449 may be disposed proximate the center of the channel receiving void 1452, in some embodiments. The outer wall 1451 may have exterior and interior surfaces, and the outer wall 1451 may define the perimeter (or circumference) of the channel receiving void 1452 (i.e., the interior surface of the outer wall 1451 may define the perimeter (or circumference) of the channel receiving void 1452).

Also, the female end 1405 may comprise a safety cover 1425, safety cover stopper 1426, and spring member 1427 to provide covering for central receiving void 1450 and channel receiving void 1452 when the female end 1405 is not engaging a male end (e.g., 905). In some embodiments, the safety cover 1425, safety cover stopper 1426, and spring member 1427 may provide functionality the same as or similar to safety cover 615, as discussed above.

To accommodate the RGB LED lamps, as discussed above, the female end 1405 may comprise four electrical contacts. As shown in FIG. 14, the female end 1405 may comprise a central contact device 1430 and a first channel contact device 1435, which are similar to central contact device 705 and channel contact device 710, discussed previously. As shown in FIG. 14, in some embodiments, the central contact device 1430 may be disposed within the circumference provided by the first channel contact device 1435, which can be ring-shaped, and the central contact device 1430 may be spring loaded (i.e., the central contact device comprises one or more spring activated contact sections). Further, female end 1405 may comprise a second and third channel contact device 1440 and 1445, respectively. In some embodiments, the second channel contact device 1440 and the third channel contact device 1445 may each be configured as a half circle such that, when brought together, they form a circular enclosure inside which the first channel contact device 1435 and the central contact device 1430 are disposed. Further, as will be appreciated, as shown in FIG. 14, the second channel contact device 1440 and the third channel contact device 1445 provide near-360° contact surface that can be in electrical communication with one or more male prongs. The second channel contact device 1440 and the third channel contact device 1445 may be made from a conductive material and function similar to, for example, channel contact device 710. Finally, as shown in FIG. 14, in one embodiment, the central contact device 1430 and first, second, and third channel contact devices 1435, 1440, 1445 comprise leads that can be connected to corresponding male prongs to complete a power distribution system.

Figures 15A, 15B:
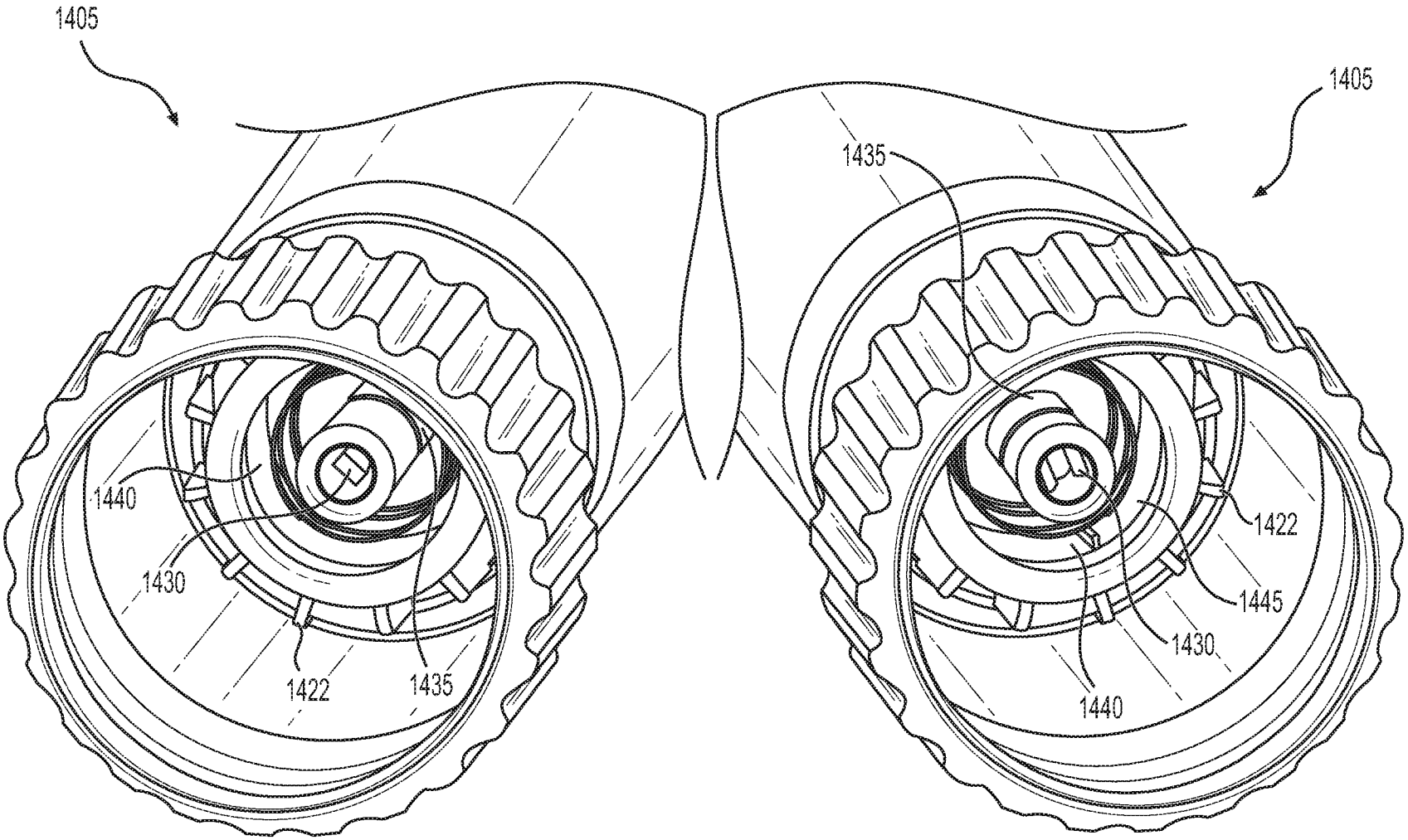
FIGS. 15A and 15B depict perspective views of a female end of a tree trunk section with clutch elements and four electrical connections, in accordance with some embodiments of the present disclosure.

FIGS. 15A and 15B are alternate perspective views of a female end 1405, according to one embodiment. As shown, the central contact device 1430 is disposed within the central receiving void 1450. In addition, the first channel contact device 1435 may be disposed proximate the exterior of female end base extension 1449. Further, as shown, the second and third channel contact devices 1440, 1445 may be disposed proximate the interior of the outer wall 1451 of the female end base 1448. As shown, the second channel contact device 1440 and third channel contact device 1445 may form a ring-shaped structure that encircles the first channel contact device 1435 with the channel receiving void 1452 disposed between the ring formed by the second channel contact device 1440 and third channel contact device 1445 and the first channel contact device 1435. As shown, in one embodiment, the second channel contact device 1440 and third channel contact device 1445 are electrically isolated, as are first channel contact device 1435 and central contact device 1430. As such, the contact devices (i.e., 1430, 1435, 1440, and 1445) are not pole sensitive and may be configured to carry a low voltage input signal or AC supply voltage. Accordingly, they allow for ease of connectivity between the female end 1405 and a male end (e.g., 905).

Figure 16:
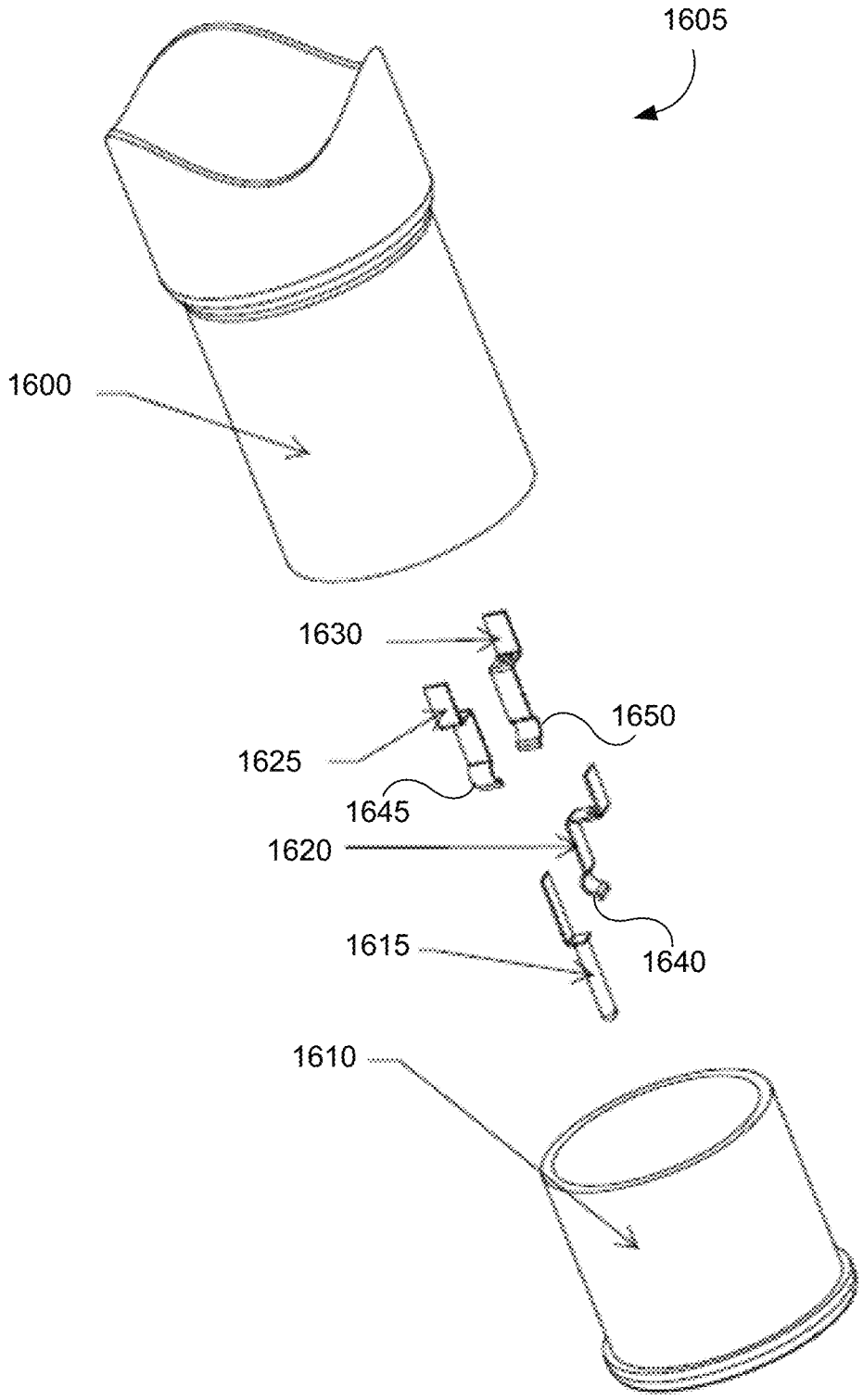
FIG. 16 depicts an exploded view of a male end of a tree trunk section with clutch elements and four electrical connections, in accordance with some embodiments of the present disclosure.

FIG. 16 is an exploded view of a male end 1605 of a tree trunk section 1600, which may be adapted to be inserted into female end 1405 to form a power distribution system. As shown in FIG. 16, in some embodiments, the male end 1605 may comprise a male connector base (or inner collar) 1610, which may be further adapted for engaging a female end 1405 and creating a coupling between the male end 1605 and the female end 1405. In particular, the male connector base 1610 may be adapted for engaging an outer collar 1415 of the female end 1405. Further, the male end 1605 may comprise various electrical prongs for electrical connection with the female end 1405 to allow for electrical communication between the male and female ends 1605, 1405. For example, in one embodiment, the male end 1605 may comprise a center male terminal prong (or central prong) 1615 that can be inserted into the central receiving void 1450 to make contact with the central contact device 1430. In some embodiments, then the center male terminal prong 1615 contacts the central contact device 1430, the center male terminal prong 1615 causes the central contact device 1430 to retract or recess, and when the center male terminal prong 1615 disengages the central contact device 1430, the central contact device 1430 returns to a neutral position.

Further, in certain embodiments, the male end 1605 may comprise a first channel male terminal prong (or first channel prong) 1620 that can be inserted into the channel receiving void 1452 to make contact with the first channel contact device 1435. Similarly, in certain embodiments, the male end 1605 may comprise second and third channel male terminal prongs (or second channel prong and third channel prong) 1625 and 1630, respectively. Second channel male terminal prong 1625 and third channel male terminal prong 1630 may be configured such that when inserted into channel receiving void 1452, second channel male terminal prong 1625 and third channel male terminal prong 1630 engage second channel contact device 1440 and third channel contact device 1445. Further, in some embodiments, first, second, and third channel male terminal prongs 1620, 1625, and 1630 may comprise a contact area 1640, 1645, and 1650, respectively, that extends from the respective prongs to engage a channel contact device (e.g., 1435, 1440, and 1445), thereby facilitating contact between the respective channel male prongs and the channel contact devices. The respective contact areas 1640, 1645, and 1650 may be flexible such that they can flex toward and away from contact devices (e.g., 1435, 1440, 1445). Additionally, in some embodiments, first, second, and third channel male terminal prongs 1620, 1625, and 1630 can be spring loaded. For example, when male end 1605 is physically disconnected from female end 1405, first, second, and/or third channel male terminal prongs 1620, 1625, and 1630 can be recessed or retracted. Likewise, when male end 1605 is physically connected to female end 1405, central first, second, and/or third channel male terminal prongs 1620, 1625, and 1630 can be extended, by spring action, to provide for electrical connectivity. As will be appreciated, employing spring loaded prongs 1620, 1625, and 1630 can help to reduce wear and tear on the prongs 1620, 1625, and 1630 and can also help to reduce the likelihood of electrical shock when the male end 1605 and female end 1405 are energized.

As discussed, because second channel contact device 1440 and third channel contact device 1445 are electrically isolated, second male terminal prong 1625 and third male terminal prong 1630 can contact either of the second channel contact device 1440 and third channel contact device 1445 to create an electrical communication.

Figure 17:
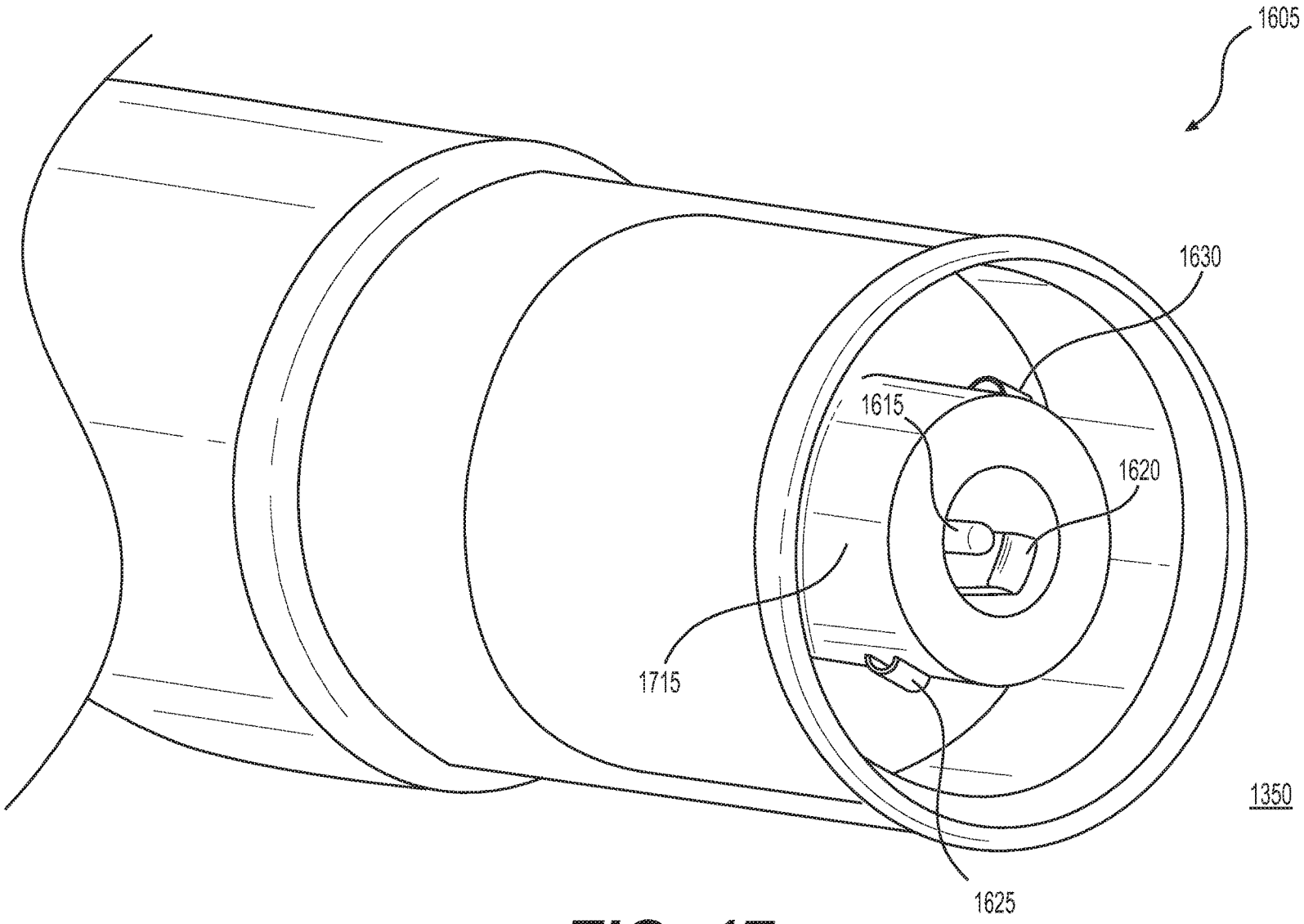
FIG. 17 depicts a perspective view of a male end of a tree trunk section with four electrical connections, in accordance with some embodiments of the present disclosure.

FIG. 17 is a perspective view of a male end 1605, according to some embodiments. As shown, the center male terminal prong 1615 is disposed proximate the center of a male end cylinder 1715. Further, the first channel male terminal 1620 may be disposed proximate the interior wall of the male end cylinder 1715. According to one embodiment, the second and third channel male terminal prongs 1625, 1630 may be disposed proximate the exterior wall of the male end cylinder 1715. As shown, in one embodiment, the second and third channel male terminal prongs 1625, 1630 may be disposed about 180° apart on the surface of the male end cylinder 1715. Further, as shown, the male end cylinder 1715 may comprise various apertures to accommodate the various channel male terminals 1620, 1625, and 1630.

As will be understood, female end 1405 and male end 1605, and the electrical contacts (e.g., 1435, 1440, 1440, and 1445) and prongs (e.g., 1615, 1620, 1625, 1630) composing the female end 1405 and male end 1605, respectively, may function the same as or similar to, and be connected to form a power distribution system in a manner the same as or similar to, the components discussed in relation to, for example, FIGS. 3B and 3C.

Further embodiments may include a male end (e.g., 1605) and female end (e.g., 1405) adapted to form a power distribution system with six electrical contacts. For example, consumers may desire Christmas trees that can accommodate LED light strings (e.g., RGB LED light strings) as well as back-fill lights. So, in such configurations, four wires are necessary for powering the RGB LED lights, and two additional wires are necessary to supply power to the back-fill lights. Typically, the four wires are used for signal lines (input and output) as well as +ve and −ve supply connections (e.g., 120V AC). The two remaining wires can be reserved for the back-fill lights and supply, for example, 29V DC. In one embodiment, the four wires are connected to a control box at the base of the tree, and the two wires for the back-fill lights are connected to a power adapter of DC power (e.g., 29V DC).

Figure 18:
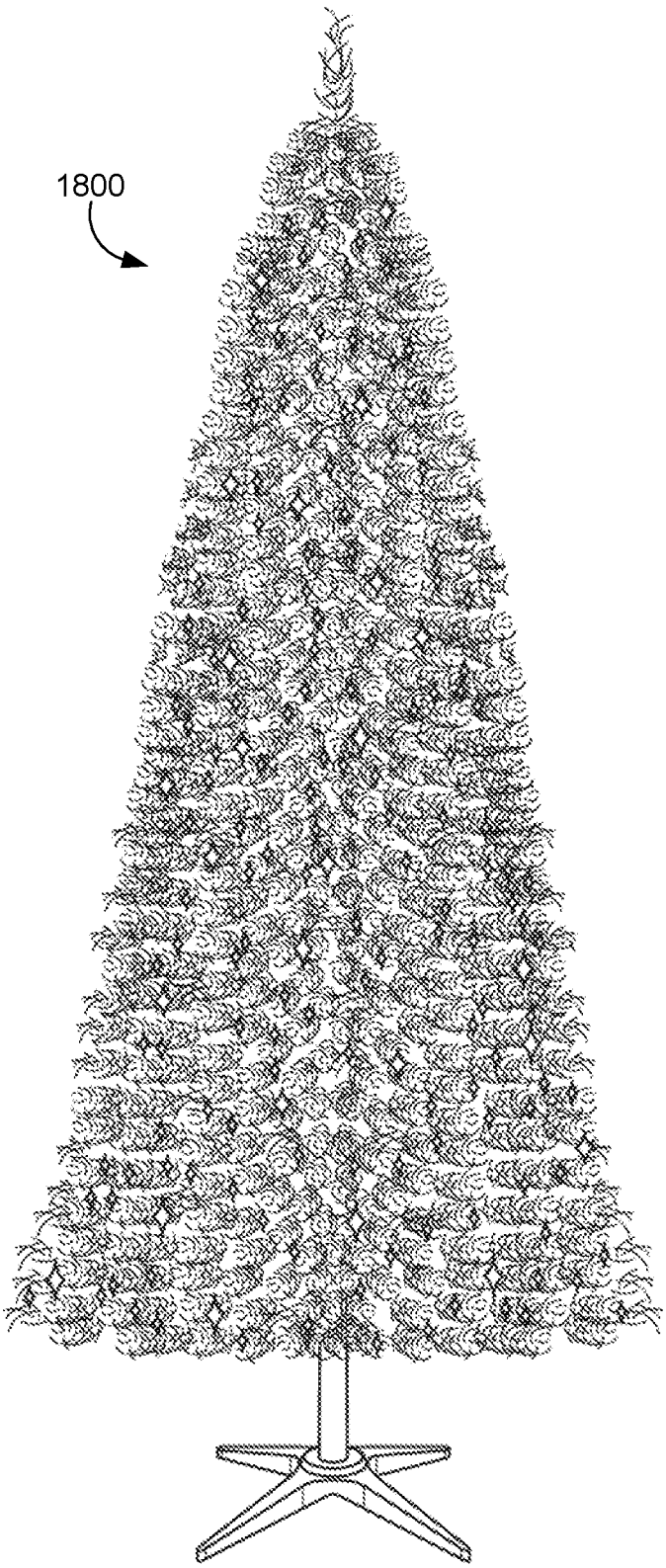
FIG. 18 depicts an assembled artificial Christmas tree, in accordance with some embodiments of the present disclosure.

FIG. 18 shows a completed tree 1800 in accordance with some embodiments of the present disclosure. The tree has been assembled by electrically connecting various trunk sections as described herein, and has been decorated in accordance with a user's liking.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An artificial tree system comprising:

a lower trunk section including:

a male end of the lower trunk section, the male end of the lower trunk section having:

a first male connector comprising a central prong and a first, a second, and a third channel prong, the central prong and the first, second, and third channel prongs of the first male connector configured to conduct electricity;

a substantially circular outer wall (i) comprising an interior surface and (ii) defining a substantially circular channel void having a bottom surface; and a substantially circular male end cylinder extending above the bottom surface of the circular channel void of the male end of the lower trunk section, the male end cylinder (i) comprising an outer surface, (ii) disposed proximate the channel void's center, and (iii) defining a central void, the central void having the central prong disposed at least partially therein, wherein the first and second channel prongs are disposed along the outer surface of the male end cylinder and the third channel prong is disposed along the inner surface of the male end cylinder;

a middle trunk section comprising:

a female end of the middle trunk section having:

a first female connector, the first female connector (i) comprising a central contact device and a first, a second, and a third channel contact device, the central contact device and the first, second, and third channel contact devices of the first female connector configured to conduct electricity;

a substantially circular outer wall (i) comprising an interior surface and (ii) defining a substantially circular channel void having a bottom surface, wherein the first, second, and third channel contact devices are disposed at least partially within the channel void and extend a uniform height above the bottom surface of the channel void; and a substantially circular female end base extension extending above the bottom surface of the channel void, the female end base extension (i) comprising an outer surface, (ii) disposed proximate the channel void's center, and (iii) defining a central void, the central void having the central contact device disposed at least partially therein, wherein the first female connector is configured to engage the first male connector such that the central contact device of the first female connector engages the central prong of the first male connector, the first channel contact device of the first female connector engages the first channel prong of the first male connector, the second channel contact device of the first female connector engages the second channel prong of the first male connector, and the third channel contact device of the first female connector engages the third channel prong of the first male connector; and a male end of the middle trunk section having a second male connector, the second male connector comprising a central prong and a first and a second channel prong, the central prong and the first and second channel prongs of the of the second male connector configured to conduct electricity; and an upper trunk section including a female end, the female end of the upper trunk section having a second female connector (i) comprising a central contact device and a first and a second channel contact device, the central contact device and the first and second channel contact devices of the second female connector configured to conduct electricity, and (ii) configured to engage the second male connector such that the central contact device of the second female connector engages the central prong of the second male connector, the first channel contact device of the second female connector engages the first channel prong of the second male connector, and the second channel contact device of the second female connector engages the second channel prong of the second male connector.

2. The artificial tree system of claim 1, wherein the lower trunk section further comprises a first and a second light string, the middle trunk section further comprises a third, a fourth, a fifth, and a sixth light string, and the upper trunk section further comprises a seventh and an eighth light string.

3. The artificial tree system of claim 2, wherein at least one of the first, second, third, fourth, fifth, sixth, seventh, and eighth light strings comprises a plurality of single-color LED lamps.

4. The artificial tree system of claim 2, wherein at least one of the first, second, third, fourth, fifth, sixth, seventh, and eighth light strings comprises a plurality of RGB LED lamps.

5. The artificial tree system of claim 4, wherein each RGB LED lamp of the plurality of RGB LED lamps comprises an embedded microcontroller unit.

6. An artificial tree system comprising:

a lower trunk section including a female end, the female end of the lower trunk section having a first female connector comprising a central contact device and a first, a second, and a third channel contact device, the central contact device and the first, second, and third channel contact devices of the first female connector configured to conduct electricity;

a middle trunk section comprising:

a male end of the middle trunk section having:

a first male connector, the first male connector comprising a central prong and a first, a second, and a third channel prong, the central prong and the first, second, and third channel prongs of the first male connector configured to conduct electricity, a substantially circular outer wall (i) comprising an interior surface and (ii) defining a substantially circular channel void having a bottom surface; and a substantially circular male end cylinder extending above the bottom surface of the circular channel void of the male end of the lower trunk section, the male end cylinder (i) comprising an outer surface, (ii) disposed proximate the channel void's center, and (iii) defining a central void, the central void having the central prong disposed at least partially therein, wherein the first and second channel prongs are disposed along the outer surface of the male end cylinder and the third channel prong is disposed along the inner surface of the male end cylinder, and wherein the first male connector is configured to engage the first female connector such that the central prong of the first male connector engages the central contact device of the first female connector, the first channel prong of the first male connector engages the first channel contact device of the first female connector, the second channel prong of the first male connector engages the second channel contact device of the first female connector, and the third channel prong of the first male connector engages the third channel contact device of the first female connector; and a female end of the middle trunk section having:

a second female connector, the second female connector comprising a central contact device and a first and a second channel contact device, the central contact device and the first and second channel contact devices of the of the second female connector configured to conduct electricity;

a substantially circular outer wall (i) comprising an interior surface and (ii) defining a substantially circular channel void having a bottom surface, wherein the first, second, and third channel contact devices are disposed at least partially within the channel void and extend a uniform height above the bottom surface of the channel void; and a substantially circular female end base extension extending above the bottom surface of the channel void, the female end base extension (i) comprising an outer surface, (ii) disposed proximate the channel void's center, and (iii) defining a central void, the central void having the central contact device at least partially therein; and an upper trunk section including a male end, the male end of the upper trunk section having a second male connector (i) comprising a central prong and a first and a second channel prong, the central prong and the first and second channel prongs of the second male connector configured to conduct electricity, and (ii) configured to engage the second female connector such that the central prong of the second male connector engages the central contact device of the second female connector, the first channel prong of the second male connector engages the first channel contact device of the second female connector, and the second channel prong of the second male connector engages the second channel contact device of the second female connector.

7. The artificial tree system of claim 6, wherein the lower trunk section further comprises a first and a second light string, the middle trunk section further comprises a third, a fourth, a fifth, and a sixth light string, and the upper trunk section further comprises a seventh and an eighth light string.

8. The artificial tree system of claim 7, wherein at least one of the first, second, third, fourth, fifth, sixth, seventh, and eighth light strings comprises a plurality of single-color LED lamps.

9. The artificial tree system of claim 7, wherein at least one of the first, second, third, fourth, fifth, sixth, seventh, and eighth light strings comprises a plurality of RGB LED lamps.

10. The artificial tree system of claim 9, wherein each RGB LED lamp of the plurality of RGB LED lamps comprises an embedded microcontroller unit.

11. An artificial tree system comprising:

a lower tree section having a first connector, the first connector including a first, a second, a third, and a fourth electrical contact, the first, second, third, and fourth electrical contacts of the first connector configured to conduct electricity;

a middle tree section comprising:

a second connector including a first, a second, a third, and a fourth electrical contact, the first, second, third, and fourth electrical contacts of the second connector configured to conduct electricity; and a third connector including a first, a second, and a third electrical contact, the first, second, and third electrical contacts of the third connector configured to conduct electricity; and an upper tree section having a fourth connector, the fourth connector including a first, a second, and a third electrical contact, the first, second, and third electrical contacts of the fourth connector configured to conduct electricity, wherein one of the first connector and the second connector is a female connector and another of the first connector and the second connector is a male connector, the female connector of the first connector and the second connector comprising:

a substantially circular outer wall (i) comprising an interior surface and (ii) defining a substantially circular channel void having a bottom surface, wherein the first, second, and third electrical contacts are disposed at least partially within the channel void and extend a uniform height above the bottom surface of the channel void; and a substantially circular female end base extension extending above the bottom surface of the channel void, the female end base extension (i) comprising an outer surface having a first portion having a first diameter and a second portion having a second diameter, wherein the first diameter is greater than the second diameter, (ii) disposed proximate the channel void's center, (iii) defining a central void, the central void having the first electrical contact of the female connector of the first connector and the second connector disposed at least partially therein, and (iv) one of the first and second electrical contacts abutting the second portion of the outer surface of the female end base extension, wherein the male connector of the first connector and the second connector comprises:

a substantially circular outer wall (i) comprising an interior surface and (ii) defining a substantially circular channel void having a bottom surface; and a substantially circular male end cylinder extending above the bottom surface of the circular channel void of the male end of the lower trunk section, the male end cylinder (i) comprising an outer surface, (ii) disposed proximate the channel void's center, and (iii) defining a central void, the central void having the first electrical contact disposed at least partially therein, wherein the second and third electrical contact devices are disposed along the outer surface of the male end cylinder and the fourth electrical contact is disposed along the inner surface of the male end cylinder, and wherein the first electrical contact of the first connector is engageable with the first electrical contact of the second connector, the second electrical contact of the first connector is engageable with the second electrical contact of the second connector, the third electrical contact of the first connector is engageable with the third electrical contact of the second connector, and the fourth electrical contact of the first connector is engageable with the fourth electrical contact of the second connector, wherein one of the third connector and the fourth connector is a female connector and another of the third connector and the fourth connector is a male connector, the female connector of the third connector and the fourth connector comprising:

a substantially circular outer wall (i) comprising an interior surface and (ii) defining a substantially circular channel void having a bottom surface, wherein the first, second, and third electrical contacts are disposed at least partially within the channel void and extend a uniform height above the bottom surface of the channel void; and a substantially circular female end base extension extending above the bottom surface of the channel void, the female end base extension (i) comprising an outer surface, (ii) disposed proximate the channel void's center, and (iii) defining a central void, the central void having the first electrical contact of the female connector of the third connector and the fourth connector disposed at least partially therein, wherein the first electrical contact of the third connector is engageable with the first electrical contact of the fourth connector, the second electrical contact of the third connector is engageable with the second electrical contact of the fourth connector, and the third electrical contact of the third connector is engageable with the third electrical contact of the fourth connector.

12. The artificial tree system of claim 11, wherein the first connector is configured to engage the second connector at a plurality of locations and the third connector is configured to engage the fourth connector at a plurality of locations.

* * * * *